US009714605B2

(12) United States Patent
Wooldridge et al.

(10) Patent No.: US 9,714,605 B2
(45) **Date of Patent: *Jul. 25, 2017**

(54) ROTARY MACHINE

(71) Applicant: Lumenium LLC, Warrenton, VA (US)

(72) Inventors: Joseph B. Wooldridge, Mineral, VA (US); William R. Anderson, Locust Grove, VA (US); Michael W. Roach, Locust Grove, VA (US)

(73) Assignee: Lumenium LLC, Fredericksburg, VA (US)

( * ) Notice: Subject to any disclaimer, the term of this patent is extended or adjusted under 35 U.S.C. 154(b) by 68 days.

This patent is subject to a terminal disclaimer.

(21) Appl. No.: 14/087,460

(22) Filed: Nov. 22, 2013

(65) Prior Publication Data

US 2014/0076270 A1 Mar. 20, 2014

Related U.S. Application Data

(63) Continuation of application No. 12/732,160, filed on Mar. 25, 2010, now Pat. No. 8,607,762.
(Continued)

(51) Int. Cl.

| | |
|---|---|
| ***F02B 53/02*** | (2006.01) |
| ***F01C 1/10*** | (2006.01) |
| ***F01C 1/46*** | (2006.01) |

(52) U.S. Cl.
CPC ..... *F02B 53/02* (2013.01); *F01C 1/104* (2013.01); *F01C 1/46* (2013.01); *F04C 2250/301* (2013.01)

(58) Field of Classification Search
CPC ..... F02B 53/00; F02B 2075/027; F02B 2053/005; F01C 1/44; F01C 9/005
(Continued)

(56) References Cited

U.S. PATENT DOCUMENTS

| | | | |
|---|---|---|---|
| 419,770 | A | 1/1890 | Hart et al. |
| 613,345 | A | 11/1898 | White |

(Continued)

FOREIGN PATENT DOCUMENTS

| | | | |
|---|---|---|---|
| CN | 100360775 | C | 8/2005 |
| DE | 3236811 | A1 | 5/1984 |

(Continued)

OTHER PUBLICATIONS

US D396,176, 1/1889, Simpson (withdrawn).
(Continued)

*Primary Examiner* — Patrick Maines
(74) *Attorney, Agent, or Firm* — Crawford Maunu PLLC

(57) ABSTRACT

A rotary machine is provided which includes a chamber. The chamber includes an island having an island outer surface. The outer surface is an elongated convex shape. The island includes a crankshaft port. The chamber includes a front-plate attached to a front surface of the island. A concave shaped contour is included, which is biased toward the island outer surface and which rotates with respect to the island. A working volume is defined between an inner surface of the contour and the outer island surface. At least one front-plate engaging bearing is provided, which extends from a front surface of the movable contour and over a guide edge of the front-plate. The front-plate engaging bearing engages the guide edge during a combustion cycle.

8 Claims, 20 Drawing Sheets

Related U.S. Application Data

(60) Provisional application No. 61/211,192, filed on Mar. 25, 2009.

(58) Field of Classification Search
USPC ..... 60/217, 228, 242, 241, 244
See application file for complete search history.

(56) References Cited

U.S. PATENT DOCUMENTS

| | | | | |
|---|---|---|---|---|
| 709,773 | A | 9/1902 | Jones | |
| 1,972,302 | A | 9/1934 | Hutchinson, Jr. | |
| 1,983,033 | A | 12/1934 | Hutchinson, Jr. | |
| 1,983,034 | A | 12/1934 | Hutchinson, Jr. | |
| 1,986,202 | A | 1/1935 | Hutchinson, Jr. | |
| 2,277,225 | A | 3/1942 | Green | |
| 2,897,798 | A * | 8/1959 | Schrougham | F01C 3/02 123/233 |
| 2,919,062 | A | 12/1959 | Tryhorn | |
| 3,186,385 | A | 6/1965 | Walker | |
| 3,187,507 | A | 6/1965 | Martin Artajo | |
| 3,230,938 | A * | 1/1966 | Hojnowski | F02B 53/00 123/240 |
| 3,245,389 | A | 4/1966 | Korf | |
| 3,259,113 | A | 7/1966 | Hamada | |
| 3,289,654 | A | 12/1966 | Geiger | |
| 3,295,505 | A * | 1/1967 | Jordan | 123/241 |
| 3,302,870 | A | 2/1967 | Schell | |
| 3,405,692 | A | 10/1968 | Paschke | |
| 3,636,930 | A | 1/1972 | Okada | |
| 3,762,377 | A * | 10/1973 | Anthony | F02B 53/12 123/211 |
| 3,884,600 | A * | 5/1975 | Gray | 418/61.2 |
| 3,952,708 | A * | 4/1976 | Burley | F02B 53/12 123/211 |
| 3,981,645 | A | 9/1976 | Herzner | |
| 4,055,156 | A | 10/1977 | Salguero | |
| 4,084,549 | A * | 4/1978 | Satow | 123/217 |
| 4,095,564 | A * | 6/1978 | Hochstein | F02B 53/12 123/211 |
| 4,142,505 | A * | 3/1979 | Inoue | 123/211 |
| 4,144,866 | A | 3/1979 | Hakner | |
| 4,850,447 | A | 7/1989 | Hirakishi et al. | |
| 5,343,838 | A * | 9/1994 | Abraham | F01C 1/22 123/218 |
| 5,380,177 | A | 1/1995 | Leroy et al. | |
| 5,423,298 | A | 6/1995 | Pahis | |
| 5,540,199 | A | 7/1996 | Penn | |
| 6,120,272 | A | 9/2000 | Gallardo | |
| 6,129,067 | A * | 10/2000 | Riley | 123/246 |
| 6,758,188 | B2 | 7/2004 | Wooldridge | |
| 7,051,698 | B2 | 5/2006 | Ollis | |
| 7,281,513 | B1 * | 10/2007 | Webb | F01C 1/22 123/200 |
| 7,621,255 | B2 | 11/2009 | Bowley | |
| 2003/0188711 | A1 | 10/2003 | Chou | |
| 2004/0011320 | A1 * | 1/2004 | Wooldridge | 123/205 |
| 2006/0185632 | A1 * | 8/2006 | Mavinahally | 123/73 V |
| 2010/0242897 | A1 | 9/2010 | Wooldridge et al. | |
| 2010/0319652 | A1 * | 12/2010 | Cooper et al. | 123/200 |
| 2012/0031369 | A1 | 2/2012 | Ki | |

FOREIGN PATENT DOCUMENTS

| | | | |
|---|---|---|---|
| EP | 1 534 943 | | 1/2004 |
| IN | 255824 | A1 | 3/2013 |
| JP | 56-18772 | B1 | 5/1981 |
| JP | 61-210228 | A | 9/1986 |
| JP | 63-065665 | A | 3/1988 |
| JP | 2002-188454 | A | 7/2002 |
| JP | 4763829 | B2 | 8/2011 |
| WO | 02/052125 | A1 | 7/2002 |
| WO | WO 02052125 | A1 * | 7/2002 |
| WO | 2004/007926 | A1 | 1/2004 |
| WO | 2010/111557 | A2 | 9/2010 |
| WO | 2010/128776 | A2 | 11/2010 |

OTHER PUBLICATIONS

International Search Report in related international application No. PCT/US2003/014906, mailed: Aug. 7, 2003.

International Preliminary Examination Report in related international application No. PCT/US2003/014906.

Supplementary European Search Report in related European application No. 03 73 1157, completed Jul. 6, 2009.

Decision of Refusal in related JP patent application No. 2004-521437, mailed: Aug. 25, 2009.

European Communication pursuant to Article 94(3) EPC, dated: Oct. 21, 2009.

Notice of Office Action in related Korean application No. 7021723/2004, transmitted: May 11, 2010.

First Examination Report in related Indian patent application 2959/CHENP/2004 (IN Patent No. 255824), dated: Jan. 23, 2012.

International Search Report in related international application No. PCT/US2010/028754, mailed: Mar. 26, 2012.

International Preliminary Report on Patentability and Written Opinion in related international application No. PCT/US2010/028754, issued: Apr. 17, 2012.

Notice of Reasons for Rejection in related JP patent application No. 2004-521437, Dec. 2, 2008.

First Office Action in related CN patent application No. 201080013906.7, Jul. 26, 2013.

* cited by examiner

ROTARY MACHINE

CROSS-REFERENCE TO RELATED APPLICATIONS

This application is a continuation of and claims the benefit of priority to U.S. patent application Ser. No. 12/732,160 filed on Mar. 25, 2010 (U.S. Pat. No. 8,607,762) which in turn claims the benefit of priority to U.S. provisional patent application No. 61/211,192. The disclosure of each of the aforementioned patent applications is incorporated herein by reference in its entirety for any purpose whatsoever.

BACKGROUND

U.S. Pat. No. 6,758,188, entitled "Continuous Torque Inverse Displacement Asymmetric Rotary Engine", the disclosure of which is incorporated herein by reference, discloses an Inverse Displacement Asymmetric Rotary (IDAR) engine. The engine includes an inner chamber wall, an outer chamber wall, and a movable contour defined by the following discussion.

Torque can be achieved throughout a combustion cycle by designing a chamber in a rotary engine such that an angle of incidence between a direction of force from a concave-shaped contour and a direction of force of an outer chamber wall at every point along the outer chamber wall during the combustion cycle is some angle greater than (0) degrees and less than (90) degrees. The shape of an inner chamber wall, the outer chamber wall, and the concave-shaped contour that are conducive to an angle of incidence between (0) degrees and (90) degrees can be determined algebraically with regard to a predetermined angle of incidence.

As illustrated in FIG. 1, with S representing a chamber wall surface and CS representing a crankshaft, the amount of torque generated by a pre-determined angle of incidence C created by a force F(r) interacting with a surface can be equal to F(r)*distance D*cos(C)*sin(C). As can be determined mathematically, torque is at a maximum value when the angle of incidence C is (45) degrees. The value of cosine*sine for a (45) degree angle is equal to (0.5). Other angles of incidence between about (20) degrees and about (70) degrees can generate suitable amounts of torque.

As shown in FIG. 2, if a radius R were held constant as it rotated through some angle D about a point CS, a tangent C to an arc described by the radius R would define a straight line between points X and Z. Tangent C makes a right angle with respect to the radius at the center of the arc (angle D/2). If line X-Z also described a surface of a chamber against which the radius was pushing, at angle D/2, the angle of incidence between a direction of force from the radius and a direction of force from the surface would be (0).

This relation describes a condition in traditional rotary engine technology, wherein the angle of incidence is (0) at the beginning and at the end of a combustion cycle. In order to achieve torque during all of the combustion cycle, the angle of incidence can be between (0) and (90) degrees at every point during the combustion cycle.

FIG. 3 depicts a tangent C between points Y and Z to an arc generated by rotation of a changing radius through some angle D about a fixed point CS. If tangent C is a surface against which the changing radius pushes, the angle of incidence between a direction of force from the radius and a direction of force from the surface would be angle E, which is some angle between (0) degrees and (90) degrees.

The changing radius length at any given point in FIG. 3 can be equal to R+dR, wherein R is a starting radius length, and dR is a variable length equal to or greater than 0. If the values of R and dR are known over an angle D, angle of incidence E can be calculated. Conversely, if angle of incidence E is known for the midpoint D/2 of some angle of rotation D, the length dR can be determined.

A mathematical formula for a curve can be derived wherein the radius of the curve makes an angle of incidence greater than 0 degrees and less than (90) degrees with a surface at every point along the curve as the radius rotates about a fixed point of rotational reference. The angle of incidence can be between about (20) degrees and about (70) degrees at every point along the curve. The mathematical formula can be used to derive a curve that can be the profile of a movable contour and a portion of a stationary inner chamber wall of the IDAR.

With continued reference to FIG. 3, a pre-determined angle of incidence E can be used to calculate an amount dR by which a radius R has to increase to maintain angle of incidence E as the radius (R+dR) rotates about a crankshaft. For an angle of incidence E of (45) degrees, the triangle XYZ in FIG. 3 has legs XY and XZ of equal length. The formulae for determination of the change in radius dR in relation to the radius R necessary to create angle of incidence E of 45 degrees are:

$$dR*(\cos(D/2))=DR*\sin(D/2))+2*R*\sin(D/2) \quad (2)$$

$$dR*(\cos(D/2)-\sin(D/2))=2*R*\sin(D/2) \quad (4)$$

$$dR/R=2*\sin(D/2)/*(\cos(D/2)-\sin(D/2)) \quad (6)$$

Formula (6) indicates that for a given angle of rotation D, for example, (1) degree, the radius R must change by a certain percentage, equal to length dR. The percentage R must change, dR/R, is constant in order to maintain a constant angle of incidence E of (45) degrees over some angle of rotation D. The percentage change can be an increase in length. For example, using Formula (6), for a (45) degree angle of incidence E to be generated over (1) degree of rotation, the radius R can increase by about 1.76%. The percentage by which R changes (dR) can remain constant regardless of the initial value of R for each degree of rotation.

A generic formula for angles other than 45 degrees can be generated by multiplying the right side of Formula (6) by a scaling factor K. Scaling factor K is the difference in the length of leg XY of triangle XYZ as compared to the length of leg XZ when the angle of incidence E is changed from (45) degrees, wherein the lengths XY and XZ are equal. When angle of incidence E is not (45) degrees, the formula is:

$$dR/R=2*\sin(D/2)/(K*\cos(D/2)-\sin(D/2)) \quad (8)$$

The scaling factor K is equal to 1/tan(E). When angle E is (45) degrees, 1/tan(45)=1, resulting in Formula (6). Where angle E is not (45) degrees, K has some value not equal to (1). Formula (8) can be used to calculate by what percentage R must change over a degree of rotation D to generate a pre-determined angle of incidence E.

A curve generated by Formula (6) or (8) using a constant angle of incidence E can rapidly spiral outward from a fixed point of rotation. For a less aggressive spiral with a smaller percentage change in radius, a changing angle of incidence E can be used. For example, the angle of incidence at the beginning of the curve can be (45) degrees or greater and less than (90) degrees, and can decrease gradually as R rotates about a fixed point. A changing angle of incidence, for example a continuously decreasing angle of incidence, can be maintained between (90) degrees and (0) degrees, or between (70) degrees and (20) degrees.

Referring to Formula (2) with relation to FIG. 3, it can be seen that the term dR*sin(D/2) defines a very small value in relation to the other terms of the formula. If term dR*sin (D/2) were subtracted from, instead of added to, term 2*R*sin(D/2), the value of the radius R would still be increasing, but more gradually, and the angle of incidence E would be gradually decreasing. Subtracting term dR*sin(D/2) from term 2*R*sin(D/2) and scaling by scaling factor K for a starting angle of incidence other than (45) degrees results in the following formula:

$$dR/R=2*R*\sin(D/2)/(K*\cos(D/2)-\sin(D/2)) \quad (10)$$

Using the above Formula (10) with a starting radius length R of (2) and a starting angle of incidence E of (45) degrees, K would be equal to (1), and a curve as shown in FIG. 4 would be generated.

FIG. 4 depicts an exemplary curve generated by Formula (10), as well as a graph of two circles, one with a radius equal to (1) unit and one with a radius equal to (2) units. With continued reference to FIG. 4, a line drawn from the origin to a tangent at any point on the curve generated according to Formula (10) will have an angle of incidence of (45) degrees at (0) degrees of rotation, and the angle of incidence will gradually decrease to about (20) degrees at (90) degrees of rotation.

An inner chamber wall of the IDAR having the contour of the curve of FIG. 4 can be generated, which can result in an angle of incidence with a concave-shaped contour beginning at (45) degrees at (0) degrees of rotation and gradually decreasing to about (20) degrees at (90) degrees of rotation. Because a contour of an outer chamber wall of the IDAR can be a function of the contour of the inner chamber wall, the angle of incidence between a direction of a component of force generating torque from the concave-shaped contour and a force of the outer chamber wall will also vary from (45) degrees to about (20) degrees during the combustion cycle.

In order to form an inner chamber wall contour, a curve generated by Formula (10), for example the curve shown in FIG. 4, can be repeated and rotated (180) degrees to form two intersecting curves of the same shape, as shown in FIG. 5. The shape generated in FIG. 5 can define an inner chamber wall of the IDAR and an island about which a concave-shaped contour of the IDAR can rotate within a chamber of the IDAR. The point of origin of the curve generated by Formula (10) can be a location of a crankshaft within the island of the IDAR. As shown in FIG. 5, the crankshaft can be off-center within the island of the IDAR. A concave-shaped contour that mates with the shape of the inner chamber wall can be generated, as shown in FIG. 6.

A chamber 2 with a concave-shaped contour 4, as exemplified in FIG. 6 can have crank pivot 6 and retainer 8 off-set in relation to a center of inner curve 10. The position of crank pivot 6 and retainer 8 can be offset, towards one side of the contour, as compared with a geometric center of the contour.

The shape of the outer chamber wall 14 can be generated by moving a concave-shaped contour around an inner chamber wall. The outside chamber wall can be designed so as to hold the concave-shaped contour against the inner chamber wall while the retainer or outer curve of the concave-shaped contour moves along the outer chamber wall. Accordingly, FIG. 6 depicts that, within the chamber 2, the contours and/or position of an inner chamber wall 16, an island 18, the crankshaft 12, the outer chamber wall 14, the concave-shaped contour 4, the crank pivot 6 and the retainer 8 is determined in relation to the curve generated by Formula (10).

It can be appreciated by visual inspection of FIG. 6 that the shape of the outer chamber wall 14 can be derived from the same mathematical function as the inner chamber wall 16. The outer chamber wall 14 can have the same shape as at least a portion of the inner chamber wall 16, but larger in scale and rotated by some angle, for example (90) degrees, about an origin during a portion of chamber 2 that corresponds to the combustion cycle.

The above described IDAR engine technology has many advantages over typical internal combustion piston engine technology. Some of the advantages that the IDAR geometry provides are different size cycle lengths.

For instance, the compression cycle can occur in a shorter stroke distance than the expansion (combustion) cycle. This allows for more work to be extracted during the longer expansion cycle when compared to piston technology of the same displacement.

Similarly, the exhaust and intake cycles do not have to be the same length either. The expansion cycle of the IDAR engine also has a mechanical transfer function into work that is nearly continuous instead of the bell curve transfer function of piston technology. This translates into a torque curve that is very flat with little variation across the rpm range. This occurs partly because the crank arm, in effect, grows in length as the expansion cycle progresses.

Also, all four of the engine cycles: intake, compression, combustion and exhaust, can have different lengths and different volumes and can occur at different rates within the same four-stroke sequence. This allows IDAR engine designers to optimize engine performance and reduce pollution by-products in a way that is superior to piston engine technology.

In addition, all four cycles occur within one complete rotation of the shaft. The IDAR engine performs somewhat like a two-cycle engine in that it has very high acceleration rates but, at the same time, it has the torque generation characteristics of a long stroke diesel engine of similar displacement. The IDAR engine geometry should not be grouped into sub-categories of performance based on bore-to-stroke ratios, as is done with piston technology, because the IDAR spans all of those categories when similar comparisons are made.

In the actual fabrication of an IDAR engine, there are complex curves and flat surfaces. The seals, however, always seal against a surface that is flat and oriented in the direction of the length of the seal material. This means that the critical manufacturing dimension is the flatness of the surfaces of the parts and the ability to align parts, such that opposite sides are parallel across the width of the engine. It is also important that parts do not twist in the direction of the path of movement and that surfaces which start off perpendicular to one another remain perpendicular to one another during the combustion cycle.

Because the cycle lengths, volumes, and rates can be different from each other and are not symmetric as in piston engine technology, it is important to have good port flow control during intake and exhaust. This allows performance standards that are beyond piston engine technology capabilities to be met.

In addition, because the IDAR engine has a unique expansion stroke, the geometry lends itself to basic power plant design based only on the expansion stroke of the IDAR. When an IDAR is connected to an external apparatus, it forms an external combustion engine or power plant powered by some other propellant, such as compressed air.

An object of the disclosure is to provide improvements to IDAR technology control, performance, ease of manufacture and the expansion of use of the IDAR technology.

SUMMARY

An inverse displacement asymmetric rotary engine is provided which includes a chamber. The chamber includes an island having an island outer surface. The outer surface is an elongated convex shape. The island includes a crankshaft port. The chamber includes a front-plate attached to a front surface of the island. A concave shaped contour is included, which is biased toward the island outer surface. A working volume is defined between an inner surface of the contour and the outer island surface. At least one front-plate engaging bearing is provided, which extends from a front surface of the movable contour and over a guide edge of the front-plate. The front-plate engaging bearing engages the guide edge during a combustion cycle.

DESCRIPTION OF THE DRAWINGS

It is to be understood that the following drawings depict details of only typical embodiments of the disclosure and are not therefore to be considered to be limiting of its scope, and in particular.

DESCRIPTION OF THE EMBODIMENTS

Figure 1:
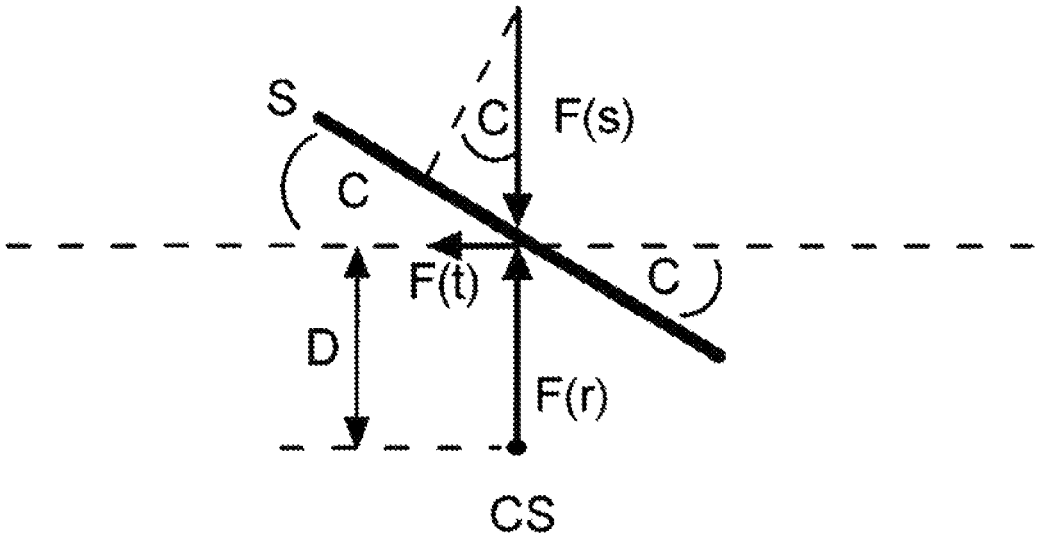
FIG. 1 depicts the geometric relationship between the force F(s) of a wall and the force F(r) of a rotor when the force of the rotor and component forces of the wall are in line.
Figure 2:
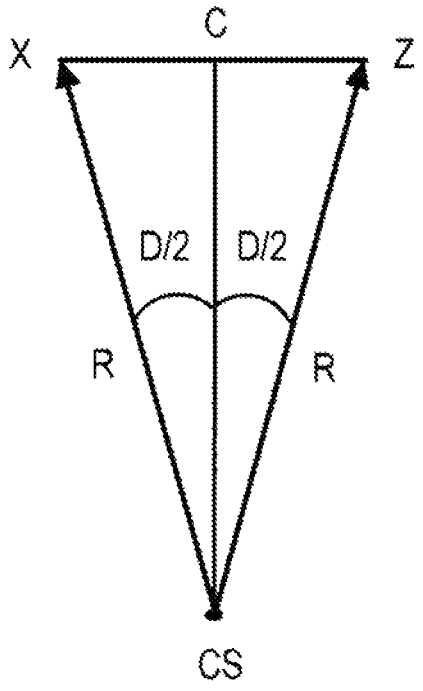
FIG. 2 depicts the geometric relationship of a radius to a curve generated by the radius wherein the length of the radius is held constant as the radius rotates some incremental amount counter-clockwise around a pivot point.
Figure 3:
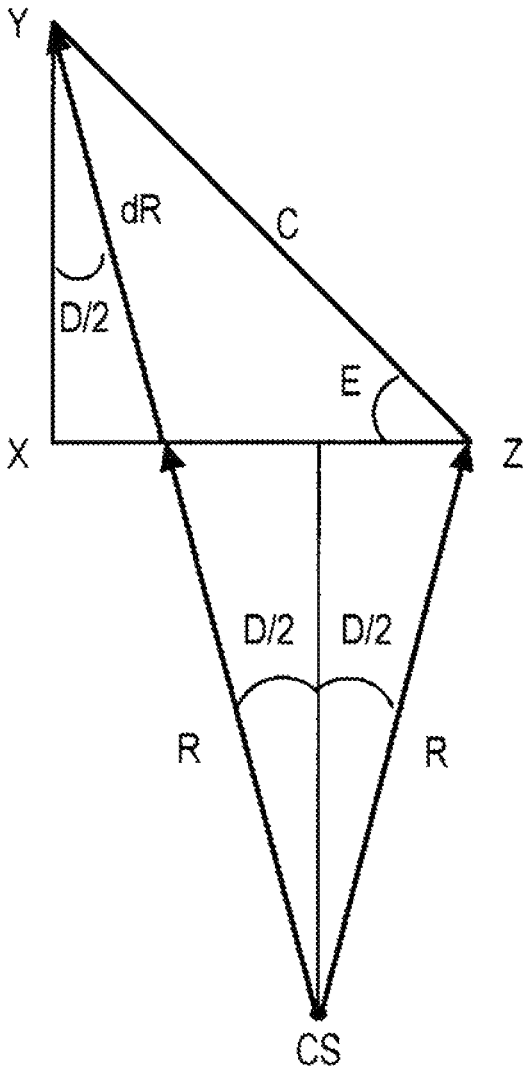
FIG. 3 is depicts the geometric relationship of a radius to a curve generated by a radius which increases in length as the radius rotates some incremental amount counter-clockwise around a pivot point.
Figure 4:
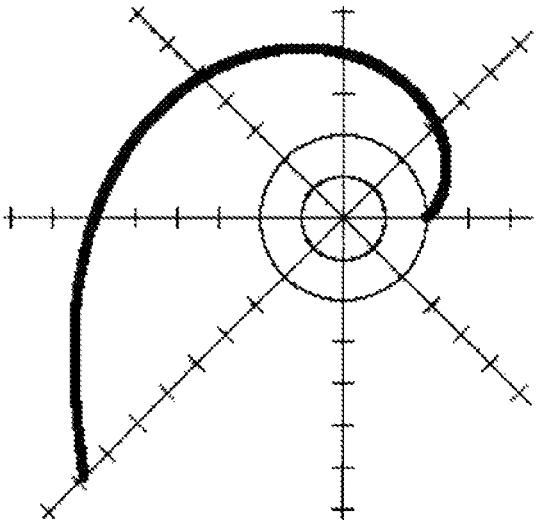
FIG. 4 is a graph of a curve generated wherein the radius constantly increases in length as the radius rotates counter-clockwise around a pivot point.
Figure 5:
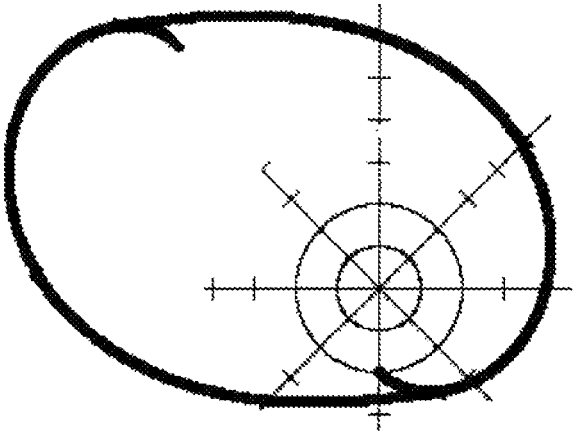
FIG. 5 depicts a shape of an embodiment of an inner chamber wall of an island and a position of a crankshaft on the island, wherein the shape is related to the curve of FIG. 2.
Figure 6:
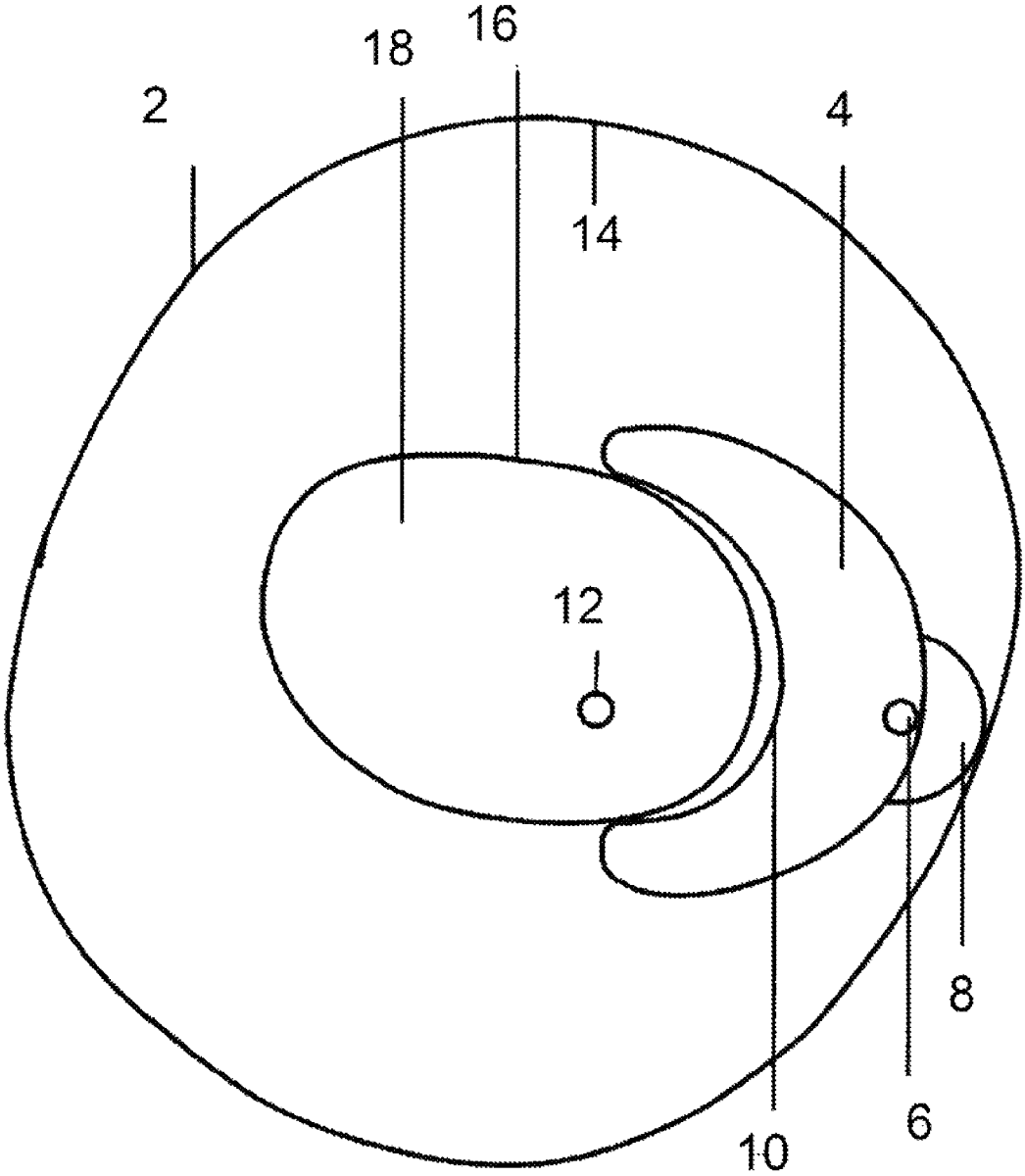
FIG. 6 is a schematic diagram of a rotary engine having the island of FIG. 3 with a concave-shaped contour, crank pivot, retainer, crankshaft and outer chamber wall.

As stated in the Background, IDAR engine fabrication involves complex curves and flat surfaces. The sealing surfaces are flat and oriented in the direction of the seal length. The engine is also arranged such that multiple flat surface pieces are aligned next to each other to form the whole engine. This means that if anyone surface is not flat either on the front or back, an error can propagate through the whole. To the extent that an error develops, then the difficulty of sealing the appropriate surfaces against one another increases. Also, the wider that a piece is, the more difficult it is to make the entire surface flat across its entire width.

To increase the level of accuracy in relative flatness and decrease the total error across all surfaces, it is best to surface grind each piece front and back. Surface grinding can reduce surface flatness variations to less than 1/10,000 of an inch across a surface if an appropriately accurate grinding machine is used. This provides accuracy across a wider area. Therefore, it is best to form the actual engine chamber as two or more pieces instead of one.

Normally the chamber is approximately a circular piece of metal roughly the thickness of the contour plus an additional amount that forms the back of the chamber. And normally the chamber is hollowed out with computer "controlled" machining bits that reach into the cavity. If the chamber is made as one piece, then it will have a rim. This rim will not allow the use of a grinding wheel to grind the back cavity of the chamber to precision flatness.

If the chamber is made up of multiple pieces, then the rim can be one piece and the back cavity of the chamber can be another piece. The back-plate then can be precision ground separately and attached to the rim with alignment posts or screws to form the entire chamber.

Another aspect of sealing flat surfaces is that in any three-dimensional cavity, two sealing surfaces will meet at a right angle. This means sealing a corner area, which requires that not only that parallel surfaces be flat relative to each other, but also that perpendicular surfaces be at exact right angles. Surface grinding each piece individually helps here as well.

A goal of an IDAR engine is that flat surfaces that align with other flat surfaces that might be in motion keep their alignment. This means that no part should twist in its movement throughout the cycles. The movable contours are the only pieces that have sealing surfaces and also move within the chamber.

FIGS. 7-13 illustrate an IDAR 20 according to a disclosed embodiment. The IDAR has a combustion chamber 22 and a working volume 24, i.e., the volume in which fuel is taken in, compressed, combusted and exhausted.

More specifically, the IDAR 20 includes a front-plate 26, an island 28, a contour 30, a rim 32 and a back-plate 34.

These IDAR components each have opposing front faces 36-44 and back faces (not illustrated) such that, in the IDAR 20, the front-plate back face is positioned against the island front face 38 and contour front face 40, and the back-plate front face 44 is positioned against the island back face, contour back face and rim back face.

The front-plate 26, island 28, contour 30, rim 32 and back-plate 34 each have an outer surface 56-64, the contour 30 and rim 32 have inner surfaces 66, 68, and the back-plate 34 comprises a secondary back-plate 70 which has an outer edge 72. Based on these IDAR components, the IDAR combustion chamber 22 is defined by the rim inner surface 68 and the island outer surface 58, and the working volume is defined by the contour inner surface 66 and the island outer surface 58.

The secondary back-plate outer edge 72 is large enough to cover the intake and exhaust ports drilled into the back face of the back plate as well as ports drilled into the secondary plate. The shape of the secondary back plate can be circular. The secondary back-plate, along with the remainder of the back plate and the front-plate 26 encapsulate the working volume 24 but do not encapsulate the combustion chamber 22, as discussed in further detail below.

The island outer surface 58 has a shape which, while discussed in greater detail, below, is based on the formula presented in the background section. All other outer and inner edges, except the rim outer edge 62 and back-plate outer edge 64, are a function of the island shape.

The rim and back-plate outer edges 62, 64 are independent of the shape of the combustion chamber. Furthermore, as the fuel is contained within the working volume, the thickness of the rim is essentially independent of the shape of the working volume. That is, while the contour back face is essentially flush with the rim back face on the back-plate 34, the contour front face 38 can extend past the rim front face 42 by the distance required to form the working volume. Accordingly, both the rim and back-plate have can be fabricated from the same stock and, as illustrated, have the same outer edge shape and thickness.

The outer edges of the rim and back-plate 62, 64 each include a bottom contour 74, 76, suitable for assisting in holding the IDAR in place during fabrication and when installed in an automobile. The bottom contours 74, 76 can generally be described as having a radius which is offset to the outside radii of the rim and back-plate, with rounded or eased opposing internal edges, e.g. 78, 80.

The rim 32 and back-plate 34 have matching alignment holes 82-88, extending in the thickness direction of the plates, which are adapted to receive alignment pins 90, 92. The alignment holes 82-88 are about (180) degrees offset from each other and spaced from the outer edges of the rim and back-plate 62, 64.

Once the alignment pins 90, 92 are in place, securing bolts or the like are passed through a series of securing holes, e.g., 94, 96, extending in the thickness direction of the plates, and circumferentially spaced about the outer diameter of the rim and back-plate 32, 34. In the illustration, there are more than a dozen such securing holes on each plate.

A set of alignment holes 98-108 is provided through the thickness of the front-plate 26, island 28, and back-plate 34. A second pair of alignment pins 110, 112 runs through the holes 98-108 to set the front-plate 26, island 28 and back-plate 34 against each other. During this placement, the contour 30 is positioned against the island 28, as will be appreciated from reading this disclosure.

Each of the front-plate 26, island 38 and back-plate 34 has matching securing holes, e.g., 114-118, extending in the thickness direction. In the illustration, each has eight such securing holes. With these holes, the front-plate 26, island 38 and back-plate 34 are secured to each other after application of the alignment pins 110-112.

The contour 30, rim 32, and back-plate 34 each have plural holes 120-130, countersunk into the respective front faces, which assist in the manufacturing process. For example, these holes enable the plates and contour to be securely positioned on CNC processing tables. The front-plate 26 and island 28 each have at least one hole 132, 134 countersunk in their respective front faces for the same purpose.

The countersunk holes on the rim 32 and back-plate 34 are circumferentially spaced and adjacent to the outside edges 62, 64. The countersunk holes in the contour 30 are spaced from each other as illustrated for providing reasonable distance and resulting in proper machining assistance. The countersunk holes on the front-plate 26 and island 28 are positioned to provide an additional function of serving as a valve channel, as disclosed below.

The back-plate 34 also includes a fuel intake port 136 and an exhaust port 138. The ports 136, 138 are defined by circular openings 140, 142 in the back-plate back face 44. The specifics of the location of these ports will become apparent from the discussion of the intake and exhaust phases of the combustion cycle, discussed below. The exhaust circular opening 142 has a larger diameter than the intake circular opening 140 to allow for the exhaust of expanded combustibles. The intake circular and exhaust openings have the same opening area as provided in a similarly situated piston type combustion engine.

The circular openings 140, 142 transition to the back-plate front face 44 plate via respective arcuate curvatures 144, 146. The purpose of the arcuate curvatures is to maximize intake and outlet flow rates from the respective openings 136, 138.

Due to the complex nature of the arcuate curvatures, discussed below, the arcuate curvatures are milled into the secondary back-plate 70 rather than the back-plate 34. The secondary back-plate is then welded to the back-plate front face 44. As can be appreciated, the secondary back-plate 70 can be a think piece of material, due to its minimal structural requirements.

The back-plate 34 also includes a sparkplug port 148, located in the area where compression occurs. A sensor port 150 is also located in the area where compression occurs.

Figure 7:
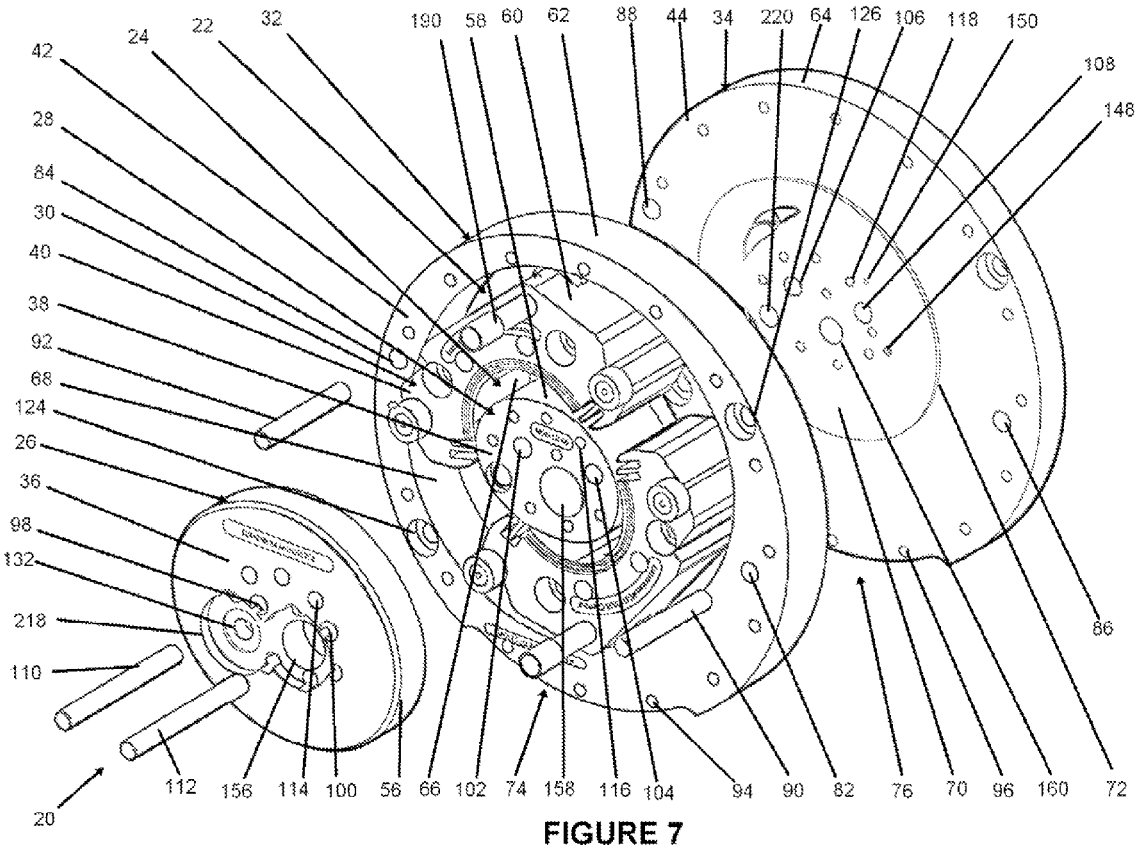
FIG. 7 is an exploded view of an engine chamber showing multiple parts with alignment posts.
Figure 8:
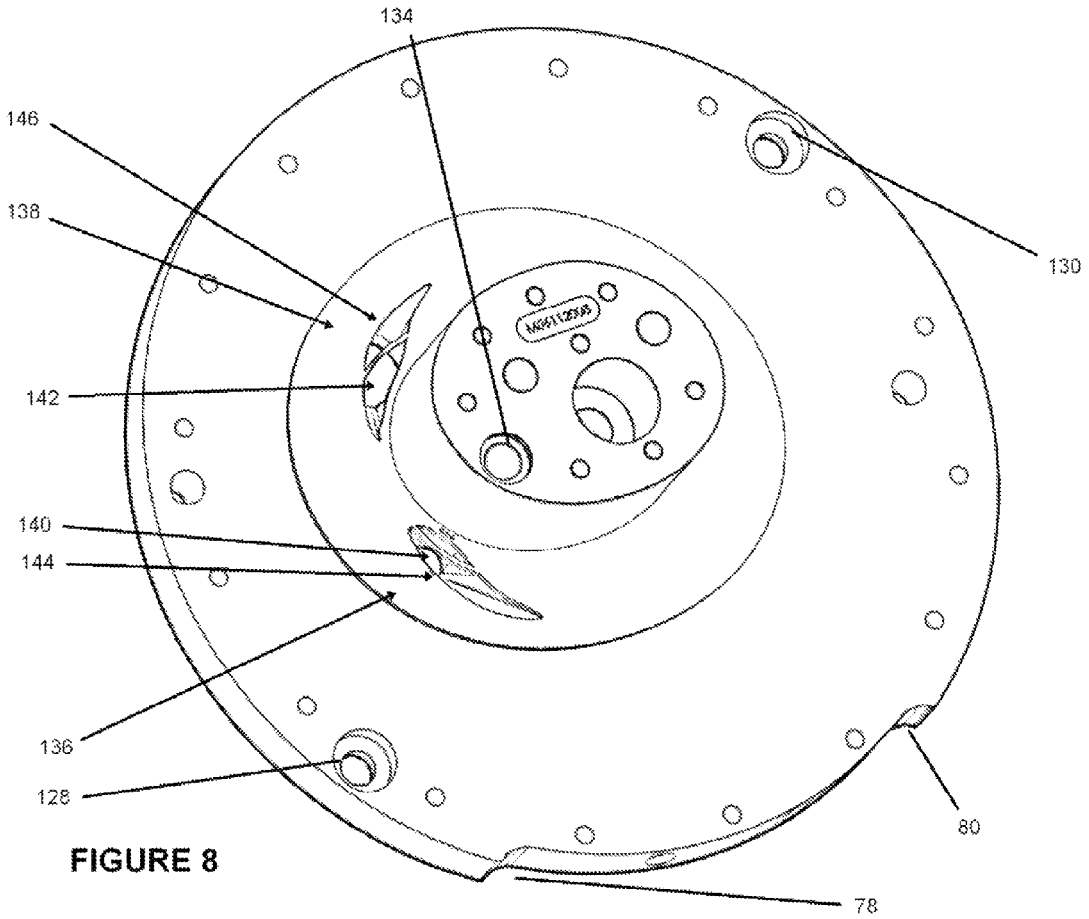
FIG. 8 is a perspective view of an island on a back-plate.

Turning back to the island 28, illustrated in FIGS. 7 and 8, the outer contour may be describable as non-circular, elongated, convex contour. This contour was generated using the formula and method described in the background section. Once generated in a program, such as SolidWorks, available from Dassault Systèmes SolidWorks Corp., 300 Baker Avenue, Concord, Mass., 01742, the shape can be easily scaled to fit a given circumstance.

Alternatively, an oval, such as an ellipse, with an offset crankshaft location would provide a similar structure with similar benefits. Again, the ellipse could be created in SolidWorks, and scaled as needed. An ellipse has a major and minor axis, and with the disclosed embodiments, the major axis is at least 25% greater than the minor axis. The semilatus rectum of the ellipse (the distance between the focal point and the local edge on the major axis) can be optimized, understanding that the greater amount of this variable provides a greater amount of expansion relative to the compression. This again, can be optimized using SolidWorks, depending on design constraints.

Furthermore, the front-plate 26, island 28 and back-plate 34 each has a crankshaft opening 156-160. With respect to the island 28, the location of the crankshaft opening 158 can be described as provided in the background section when employing the formulation disclosed therein.

Alternatively, when using an ellipse, the location of the crankshaft opening is substantially in the bottom-right quadrant of a graph created by the major and minor ellipse axes. In the illustration, the outer diameter of the countersunk bore tangentially touches the major and minor ellipse axes (see FIG. 10). However, the crankshaft bore could be moved further into this quadrant as required. As the placement of the crankshaft moves further into this quadrant, the movable contour moves more slowly while traversing the compression stage, which changes the combustion cycle timing. Again, this is can be optimized under given design constraints by modeling with SolidWorks.

The crankshaft opening in the front-plate is countersunk into its front face so that a disk, attached to the crank shaft, and discussed below, can sit flush which the front-plate.

Figure 9:
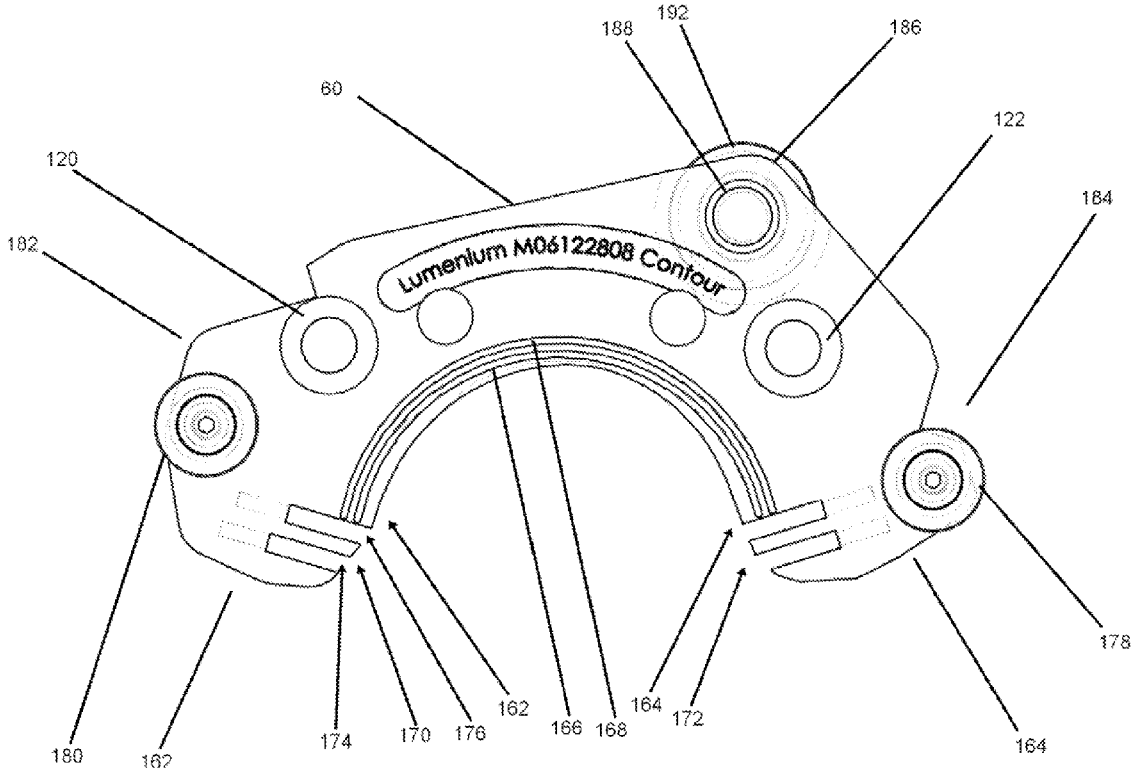
FIG. 9 is a side view of a contour showing roller bearing placement.
Figure 10:
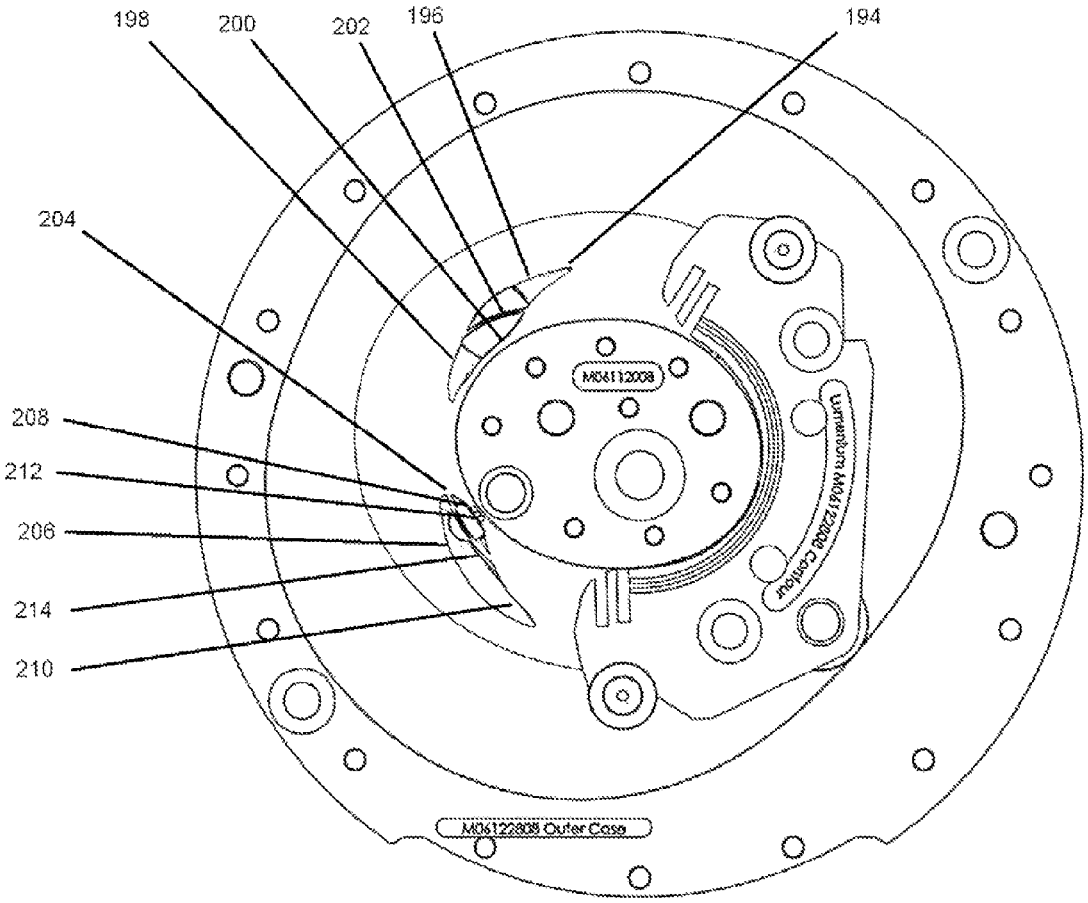
FIG. 10 is a side view of the engine chamber with the contour at compression position.

FIGS. 9 and 10 illustrate the contour 30 in the compression stage of the combustion cycle. As can be seen, the contour inner surface 66 is a function of the island outer surface 58. That is, the contour 30 inner surface 66 is essentially the same shape of the island in the compression zone, but slightly larger so as to move freely about the island. This space is also adjusted to achieve a desired compression ratio for the working volume. As illustrated, the contour has opposing substantially circumferential ends 162, 164.

The working volume at this segment of the combustion cycle is equivalent to the volume of a piston in a top-dead-center position. The location of the sparkplug port 148 positions the plug electrodes in the center of the working volume during the peak of compression. The sensor port 150 is exposed to the fuel in this position of the contour in the chamber 22.

The contour includes a pair of side seals 166, 168 on its front and back face (only front face seals are illustrated). The side seals on the front face of the contour press against the rear surface of the front-plate 46. The side seals on the rear face of the contour press against the secondary back-plate 70 on the back-plate 34.

The side seals 166, 168 terminate at two pair of apex seal apertures 170, 172 (seals not illustrated), one pair being located on each opposing circumferential end of the contour 162, 164. The apex seal extend between the front-plate and the lip, they contact the island, the surface of the front-plate and the back-plate, and are made of, e.g., cast iron. The effect of the seals is to seal the fuel in the working volume.

In each apex seal aperture pair, an outboard seal aperture 174 terminates radially outside of an inboard seal aperture 176. This radial gradient assists in preventing the contour from jamming while revolving about the island.

The contour 30 includes a pair of roller bearings 178, 180 positioned on the front face of the contour 30. The bearings 178, 180 are at opposing circumferential ends of the contour 30 and radially outside of the apex and side seals, at opposing ends 182, 184 of the contour outer surface 60. The bearings roll about the outer edge 56 of the front-plate during operation of the IDAR, so that the outer edge 56 serves as a guide edge. Accordingly, the trace of this motion defines the profile of the outer edge 56 of the front-plate.

As illustrated in the figures, the opposing ends 182, 184 of the contour outer surface 60, and therefore the outer edge 56 of the front-plate, are radially within the rim inner surface 68. This assures that the ends 182, 184 do not disrupt the motion of the contour 30 during operation of the IDAR.

The contour outer surface 60 connects with the rim inner surface 68 at one location. This location is an outer peak 186 in the contour outer surface 60. The contour outer peak 186 is also the location of a crank pivot opening 188. As indicated in the background section, the location of the contour outer peak is circumferentially offset, in the direction of one circumferential end 164, by, e.g., twenty five percent, as compared with a geometric center of the contour. Alternatively, using SolidWorks, the location can be optimized based on design criteria by moving the outer peak further towards or away from the island surface and towards either of the contour circumferential end 162, 164.

By keeping the contour outer peak at the same radial spacing from the island surface, and moving the contour outer peak towards either circumferential end of the contour, one can change the location of top-dead-center, and thus phasing the motion of the contour relative to the combustion cycle. On the other hand, by decreasing the radial spacing, but holding the circumferential spacing constant, a decreased benefit occurs of having less room for placing all components of the contour. By pushing the contour outer peak radially further away from the island surface, the rim can become too large, without necessarily obtaining benefits in torque realization.

The contour includes an outer peak roller 192, which enables smooth rolling of the contour outer peak 186 against the rim. Accordingly, the rim thickness, while essentially independent of the working volume, is thick enough to support the peak outer roller 192. Furthermore, the profile of the rim inner surface 68 is such as to force contour in position so that the apex seals 170, 172 are continuously pressed against the inner surface of the contour 66.

As can be appreciated, the profiles of the front-plate outer surface 56, the island outer surface 58, the contour inner surface 66, the contour outer surface 60, the secondary back-plate profile (due to the location of the intake and exhaust ports), and the rim inner surface 68 are all mutually dependent. Of these components, the island outer surface 58 is the starting point as it provides for the greatest return in IDAR efficiency.

Figure 11:
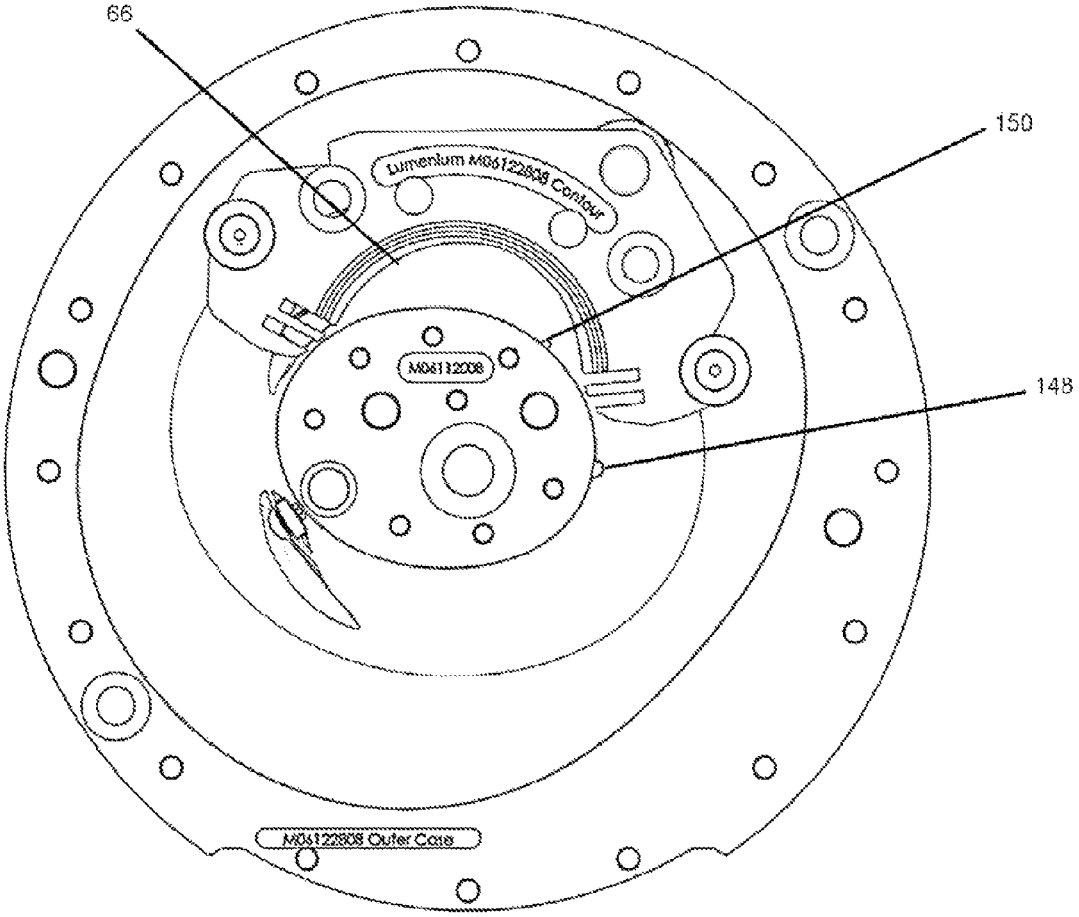
FIG. 11 is a side view of the engine chamber with the contour at expansion position.

FIG. 11 illustrates the expansion phase of the combustion cycle. The working volume at this segment of the combustion cycle is equivalent to the volume of a piston in a bottom-dead-center position. By comparing this illustration with FIG. 10, one can gain an understanding of the exhaust arcuate opening 146. During expansion cycle, the exhaust port is "closed." To achieve this, the exhaust port has a leading edge 194, i.e., an edge reached first by the contour 30. This edge 194 is positioned such that the internal edge of the contour 66 does not contact the exhaust port until the expansion phase is completed. As illustrated in FIG. 11, the leading edge 194 of the exhaust port is not visible in the working volume.

Figure 12:
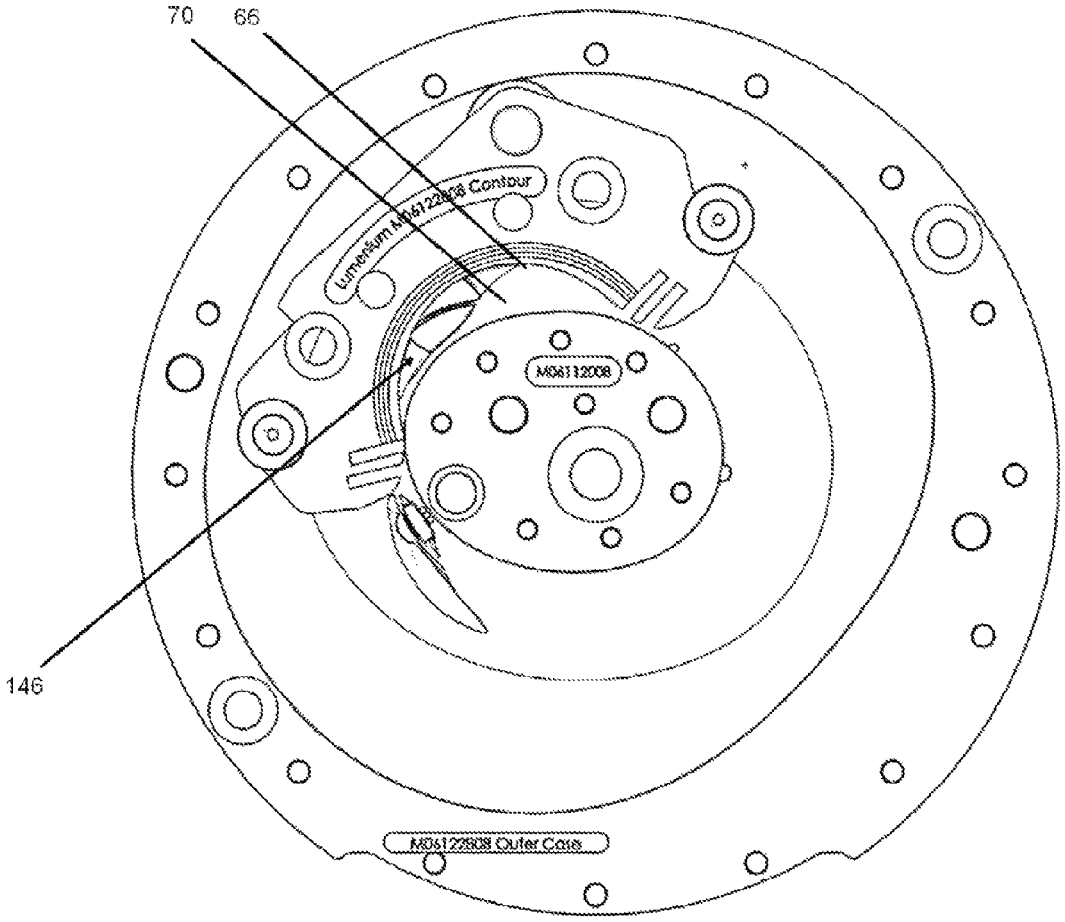
FIG. 12 is a side view of the engine chamber with the contour at exhaust position.

Turning to FIG. 12, the exhaust phase of the combustion cycle is illustrated. As compared with FIG. 10, the exhaust port has a top edge 196, a trailing edge 198, and a radially inner edge 200. These edges essentially trace the projection of the contour inner surface 66 against the secondary back-plate 70 in the location of the contour 30 at the peak of the exhaust phase. An angular separation 202 in the exhaust arcuate profile 146 helps control the flow of exhausted combustibles. The separation 202 is aligned with the flow streamlines in its location.

Figure 13:
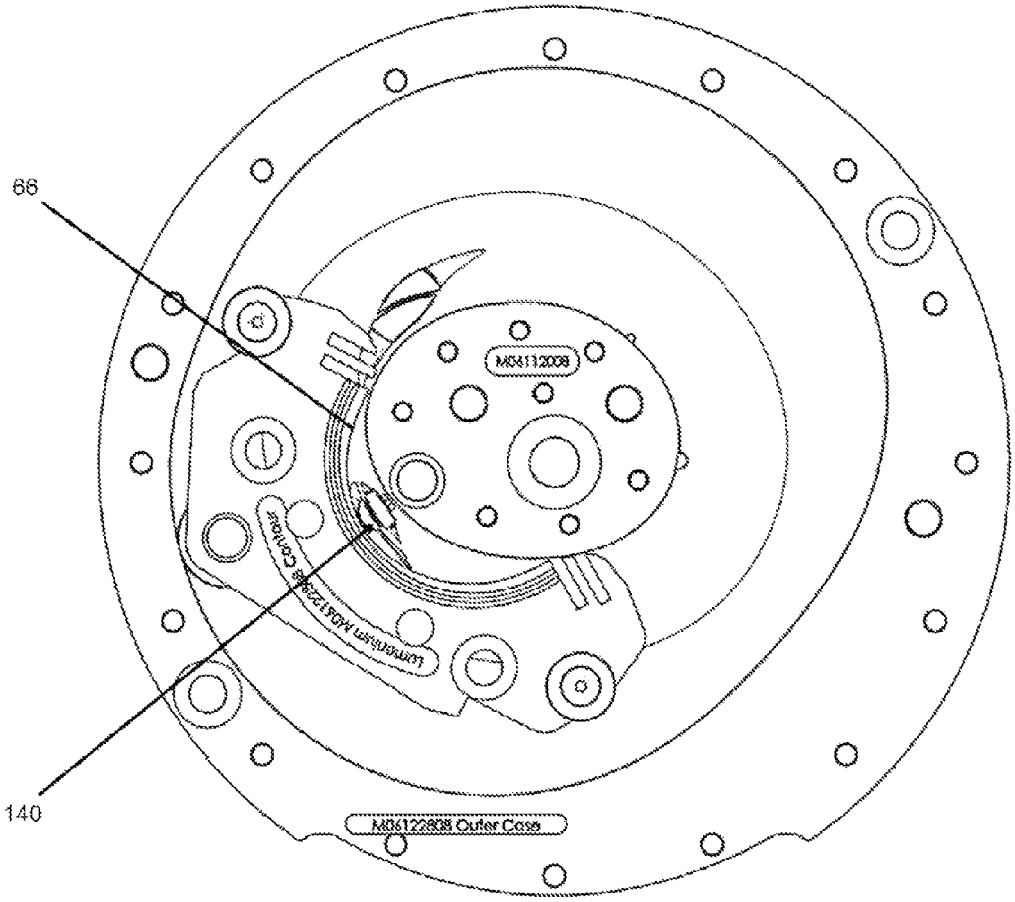
FIG. 13 is a side view of an engine chamber with a contour at intake position.

Turning to FIG. 13, the intake phase of the combustion cycle is illustrated. The shape of the intake arcuate opening 142 can be understood when comparing FIG. 13 with FIGS. 10 and 12 and understanding how the exhaust arcuate opening was obtained.

As illustrated in FIG. 12, the intake arcuate opening has a leading edge 204 which does not project onto the contour 30 when the contour is in the location of maximum exhaust. The intake arcuate opening has a bottom edge 206 which is based on a projection of the contour onto the base plate as the contour travels through the intake phase, illustrated in FIG. 13. A first portion 208 of the top edge of the intake extends to the island while a second, larger portion 210 does not. This larger portion 210 traces the contour inner surface 66 at the start of the compression phase (not shown). A series of holes 212 and an angular separation 214 are also provided to assist in proper fuel flow. The separation 214 extends in the direction of the flow streamlines in its location.

The roller bearings 178, 180, discussed above, keep the contour 30 from twisting and binding-up the side seals 166, 168 and apex seals 170, 172 during the above discussed combustion cycle. The bearings 178, 180 take twisting moments off of the seals 166-172 and contour 30 as well.

An improvement to IDAR intake volumetric efficiency can be obtained in the following alternative embodiment. As an alternative to intake port 136, small holes (not illustrated), similar in size to holes 212, illustrated in FIG. 10, may be drilled at a right angle through the island outer surface 58. These holes would be drilled into the island countersunk hole 132, in the area where the intake circular opening 140 is located in the previously disclosed embodiment. A corresponding countersunk hole 218 is provided in the front-plate 26 as well as a through hole 220 in the back-plate 34. These holes have a diameter of about (½) an inch.

Figure 14:
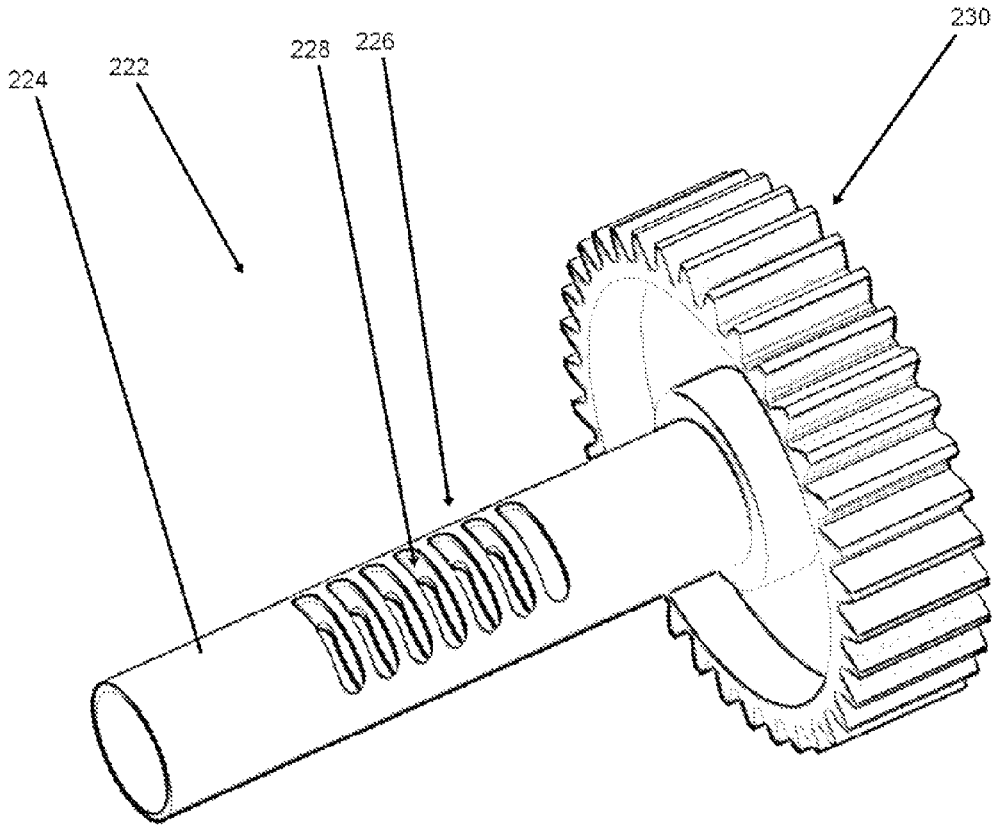
FIG. 14 is a perspective view of a barrel valve design.

A barrel valve 222, as shown in FIG. 14, is inserted into the front-plate opening 218 and into the channel created by the hole 132, to control the opening and closing of the smaller intake holes. Specifically, the barrel valve includes a hollow cylinder 224 with two sets 226, 228 of plural slots (seven slots illustrated in each set) on circumferentially opposing sides of the barrel valve 222. The slots are perpendicular to the longitudinal axis of the barrel valve and extend about the barrel valve by about a quarter of the total valve circumference.

The valve includes a geared top disk 230 which sits in and rotates within the countersink impression 218. The gears 230 are intermeshed with an identical gear on the crankshaft (not shown) residing in the first countersunk front-plate hole 134. From this meshing, the barrel valve 222 may be opened and closed twice for every revolution of the IDAR engine.

With the above technique, volumetric efficiency ratios greater than 100% have been observed.

Figure 15:
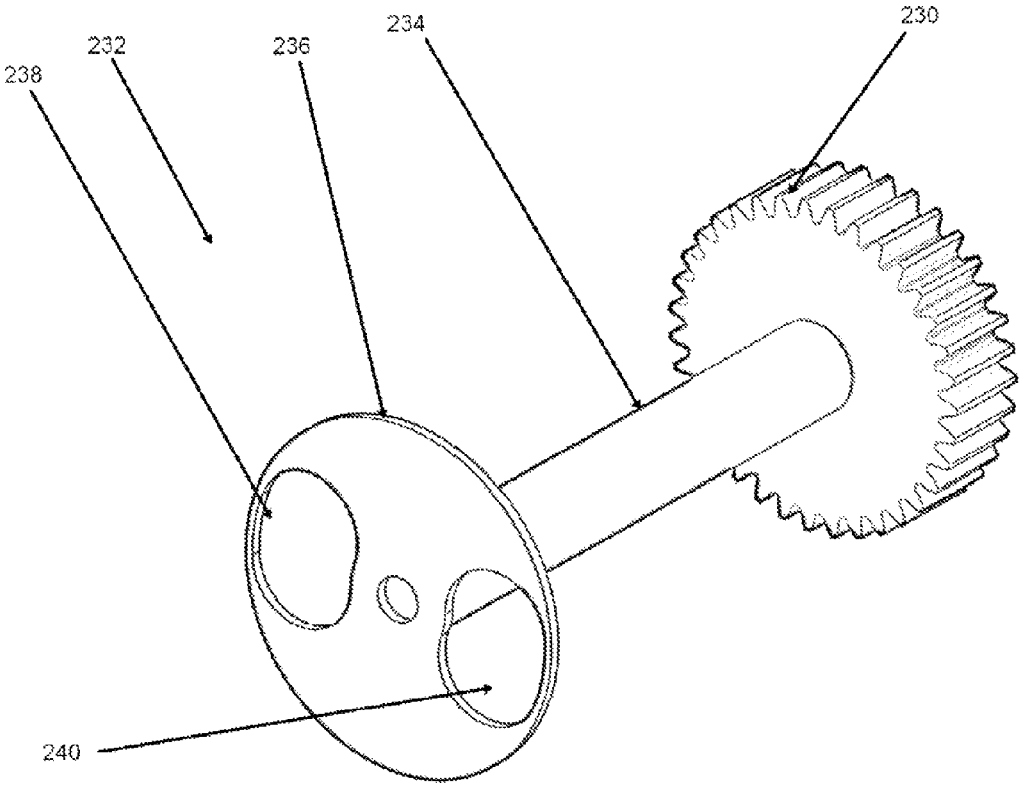
FIG. 15 is a perspective view of a rotary valve design.

An alternative intake configuration includes the originally disclosed intake 136 and a rotary valve 232, illustrated in FIG. 15. This embodiment does not include the smaller holes in the contour outer surface 60 but does include the additional countersunk front-plate hole 218 and the back-plate through hole 220.

The rotary valve 232 also includes a top geared disk 230, a cylinder 234 which may or may not be hollow, and a bottom disk 236. The bottom disk 236 sits against the bottom face of the back-plate, and has a diameter which is large enough to extend over intake circular opening 140.

The bottom disk 236 has two arcuate openings 238, 240, at circumferential opposing locations on the disk 236. The openings are each about thirty to forty percent of the area of the disk 236. With this valve 232, the intake 136 is opened and closed twice for every revolution of the engine by the disk openings 238, 240.

Figure 16:
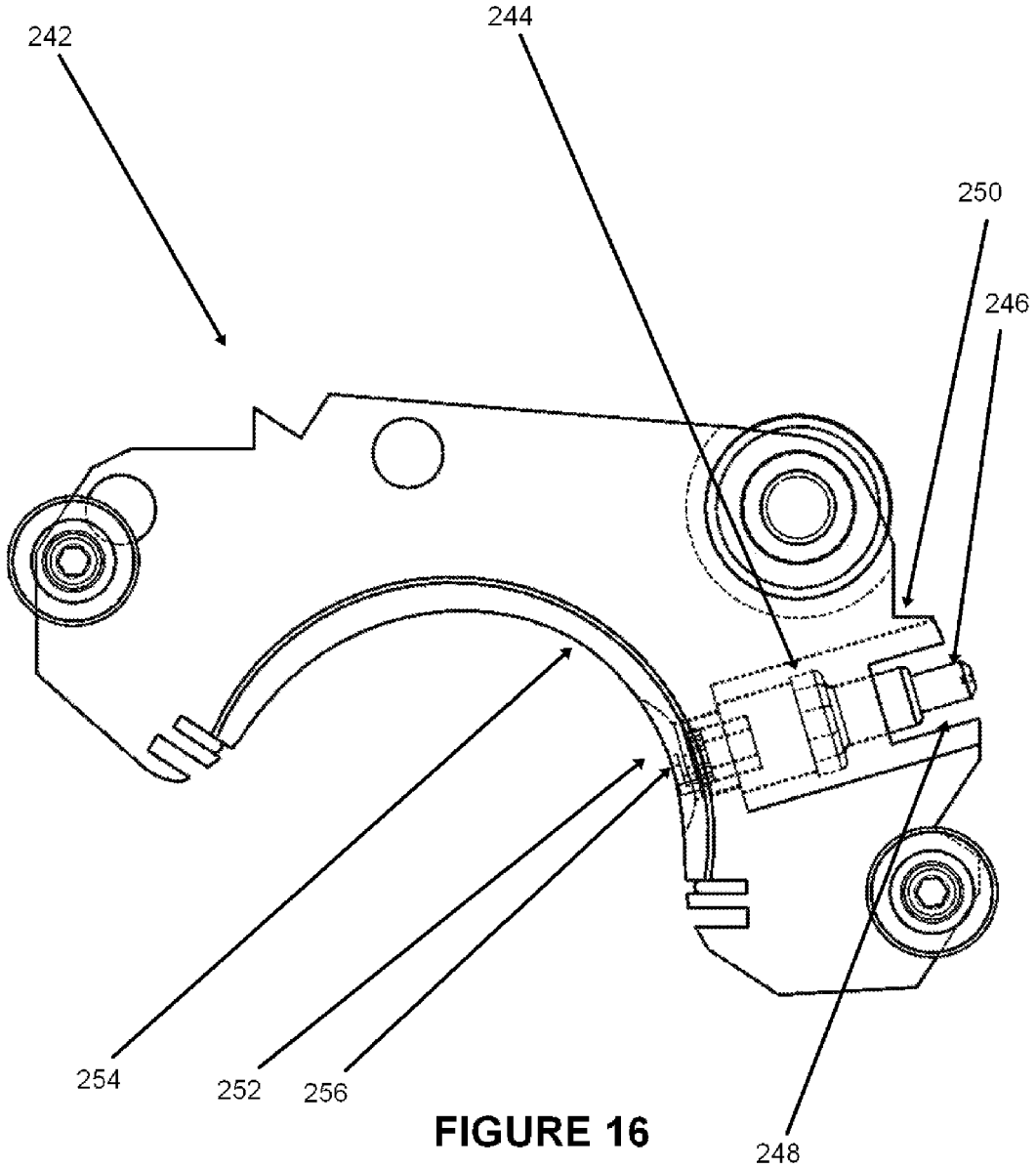
FIG. 16 is a side view of a contour with sparkplug mounted therein.
Figure 17:
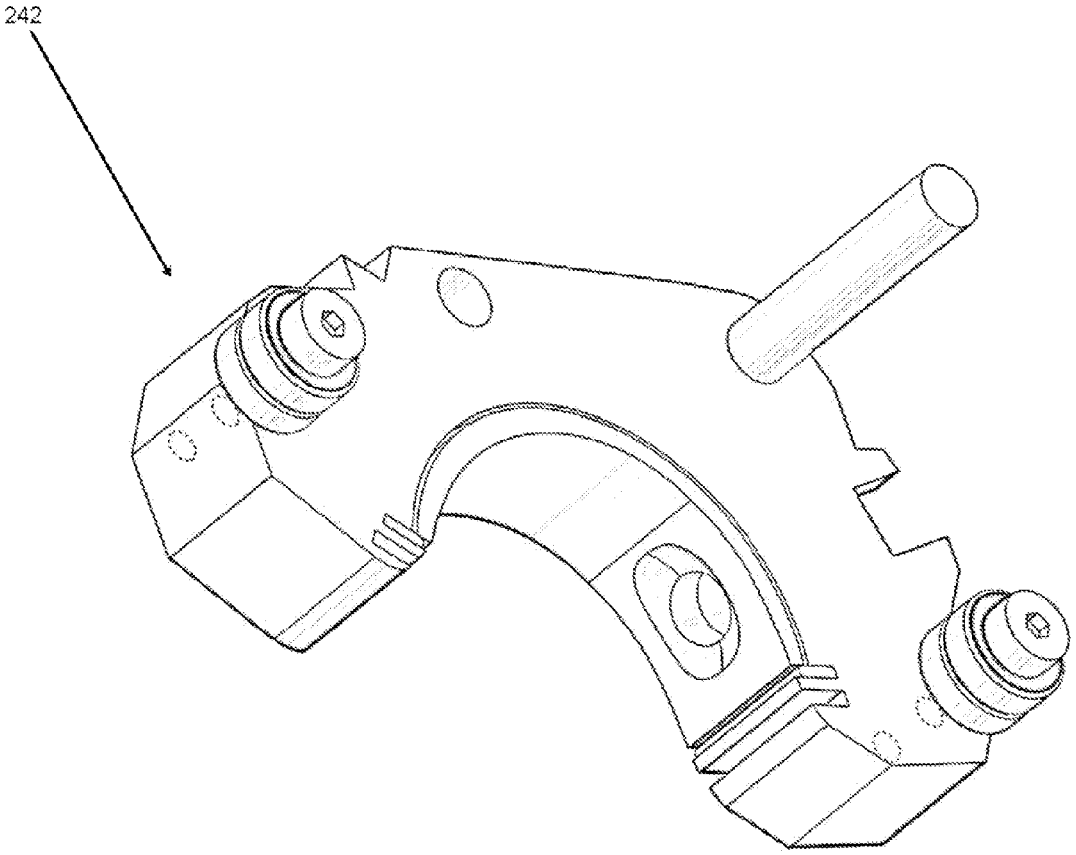
FIG. 17 is a perspective view of a contour capable of being mounted with a sparkplug.

A further alternative embodiment is illustrated in FIGS. 16 and 17. In this embodiment, the sparkplug entry hole 148 in the back-plate 34 is unnecessary. Rather, in this embodiment, an alternative movable contour 242 includes one or more countersunk holes 244, each adapted to fit a sparkplug 246. An opening 248 in the hole 244 in the outside surface 250 of the contour provides access to the sparkplug, while an opening 252 in the inner surface of the contour 254 allows the electrodes 256 to enter the working volume. Antenna wire (not shown) are attached to the sparkplug connection.

As compared with positioning the sparkplug at a fixed position in the back-plate, this alternative embodiment provides a highly predictable burn, even as different rates of contour movement occur. This is because the contour mounted sparkplugs are always in the exact position in which it is desired to have the combustion process begin.

In addition, a spark gap is created by placement of a metal plate (not shown), connecting to a high-voltage coil (not shown), near the combustion area along the front-plate 26. As the contour 242 moves near the high voltage plate, the spark jumps to the moving sparkplug 248 and through the sparkplug to the sparkplug gap to initiate the combustion process.

Figure 18:
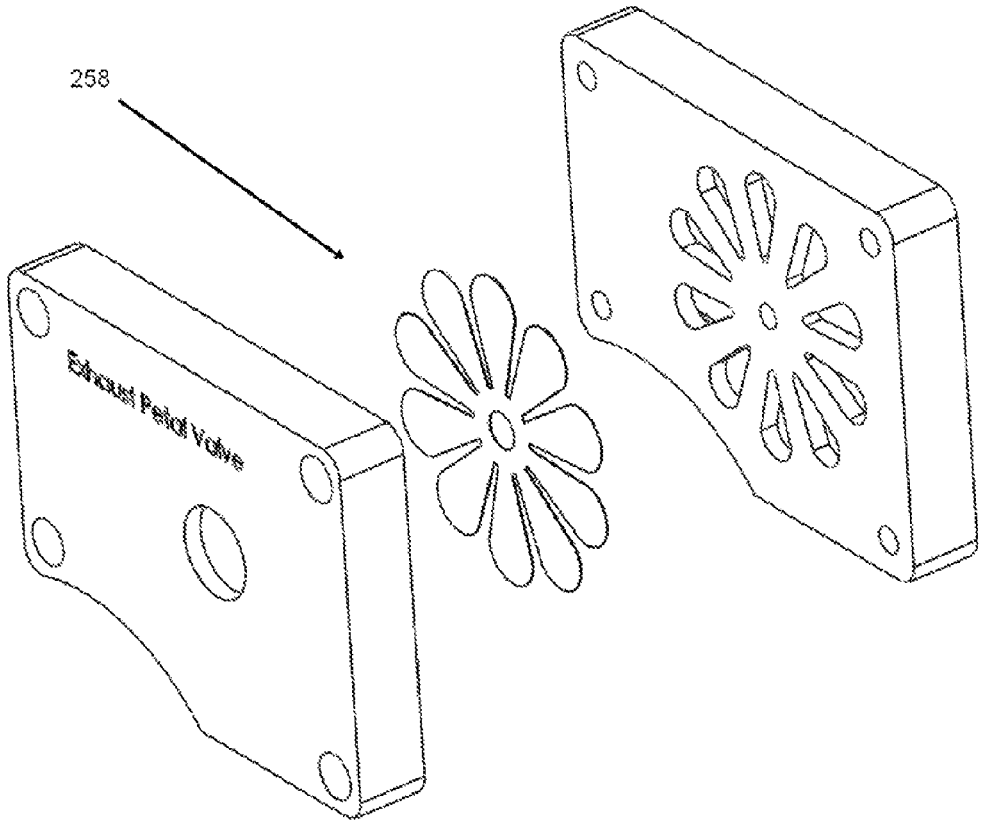
FIG. 18 is an exploded view of a petal valve design.

In a further alternative embodiment, pumping losses associated with the exhaust cycle can be improved by the addition of a control petal valve 258, illustrated in an exploded view in FIG. 18, on the back face of the back-plate, at the exhaust port 138. The contours pass over the exhaust area during the exhaust cycle and then leave the exhaust port open to atmospheric pressures. This increases pumping friction at exhaust because the gases are not contained in one direction of movement.

Specifically, the petal valve seals the exhaust port during the time that no contour 30 is present and prevents the exhaust from backing up into the engine chamber. In another embodiment of the disclosure, a rotary valve (not illustrated) is used for this purpose.

In another alternative embodiment, the contour is modified to store a certain amount of exhaust and combine it with new fuel during the intake process. This would be desirable, during the transition from exhaust cycle to intake cycle, for purposes of controlling the kind and amount of combustion byproducts.

The type of contour which could be modified to allow for internal gas re-circulation is similar to the contour 242 in FIG. 17. The inner surface opening 252, which is hemispherical, is provided, which, instead of terminating at the opening 248 in the outside contour surface 250, terminates internally, within the contour, and traps spend fuel. In this way, a pre-selected amount of exhaust gases are recombined with new fuel and used to control the temperature of combustion in such a way as to reduce dangerous pollutants.

Alternatively, re-circulation is achieved by moving or downscaling the exhaust port such that it is not cable of exhausting all combusted fuel (e.g., the exit area cannot accommodate the exhausting mass flow), thereby transporting the remainder into the new fuel during intake. A piston engine would be unable to accomplish this without the use of additional valves, and complicated cam-shaft timing, as is known in the industry.

Figure 19:
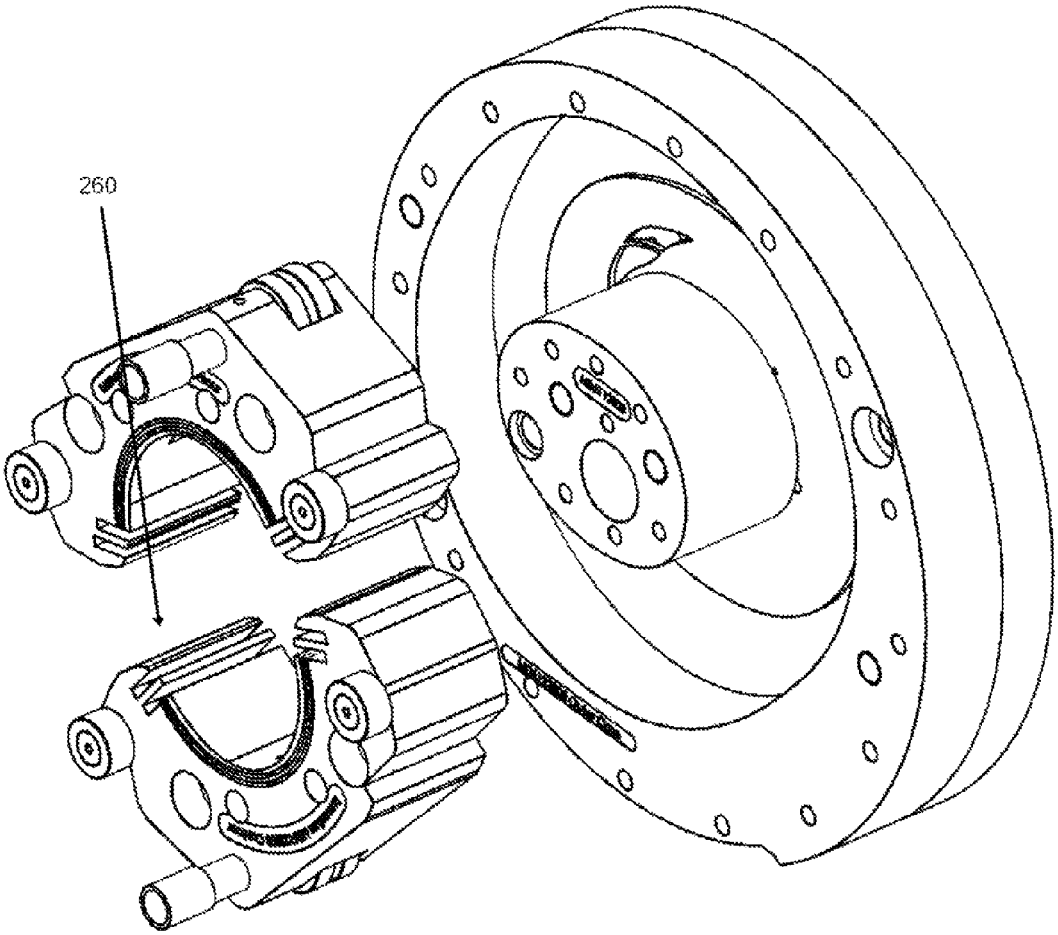
FIG. 19 is an exploded view of a two-contour engine assembly.

FIG. 19 is an exploded view of a two-contour engine assembly, including the original contour 30 and an identical, second contour 260. All aspects of the above initially disclosed embodiment are the same with this alternative embodiment. The resulting structure is the equivalent of a two valve engine, even though only one chamber is being utilized.

Figure 20:
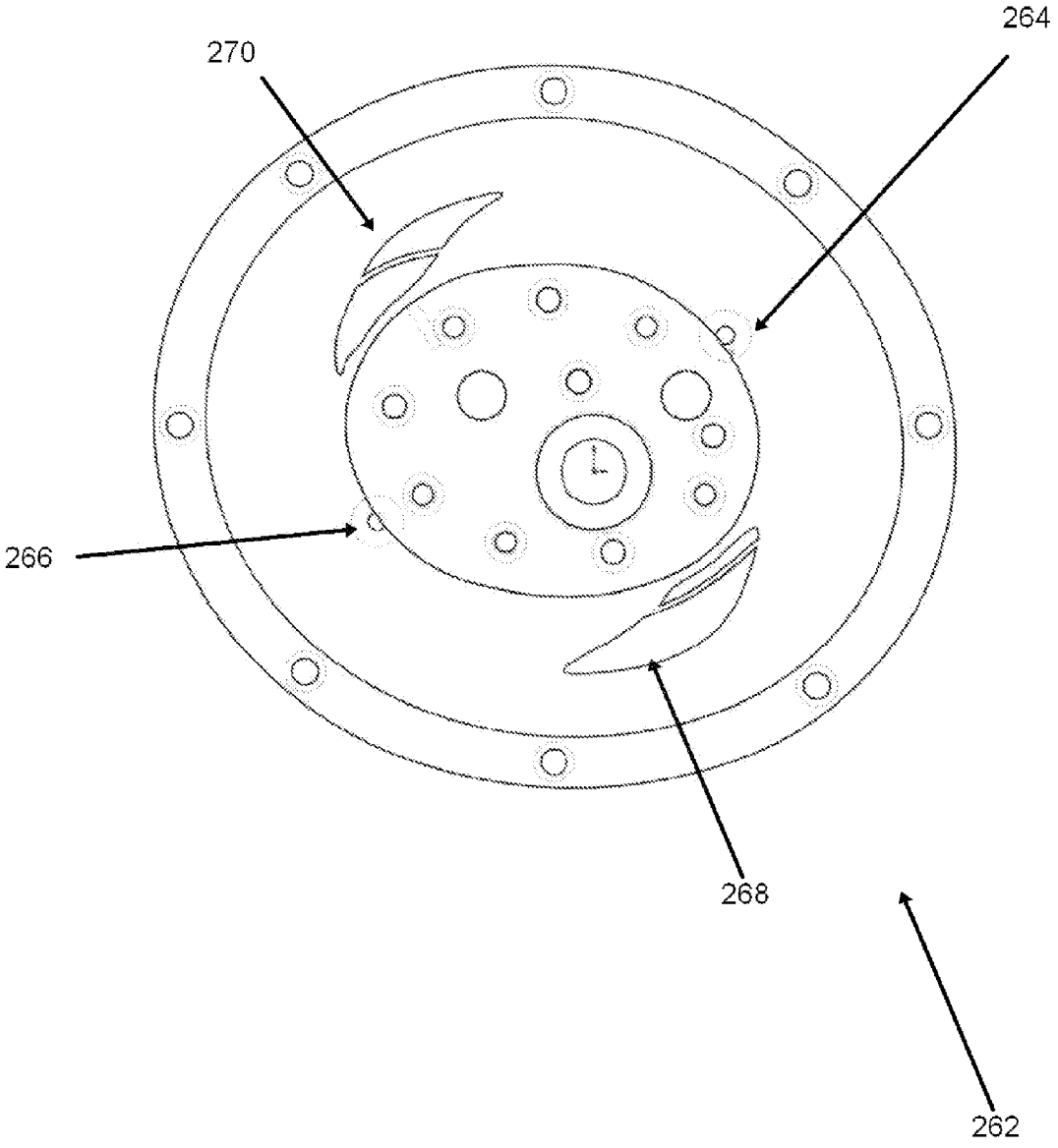
FIG. 20 is a front elevational view of an alternative back plate.

Alternatively, with a back-plate 262 illustrated in FIG. 20, the disclosed IDAR engine embodiment can be utilized outside the technical category of internal combustion engines. IDAR technology has a much more favorable mechanical transfer into torque than piston technology of similar displacement. More useful work is output per unit of displacement than with piston technology. Because of this, using only the IDAR expansion cycle (combustion, without the spark induced explosion) and the IDAR exhaust cycle; the supporting intake and compression cycles occur in an external but connected apparatus, which increases overall efficiency. Furthermore, in such an application, because the contour still moves about the entire island, the IDAR intake and compression cycles can be used as secondary IDAR expansion and exhaust cycles within the same chamber.

Technically, these applications utilize only the IDAR expansion and exhaust cycles to provide external combustion engines or compressed air power plants rather than internal combustion engines. The high pressure air or other propellant is supplied from an external but connected apparatus to effect the movement of the contours.

To achieve this alternative configuration, the back-plate 262 includes two intake holes 264, 266, which can be similar in size to the spark plug holes, which provide ports for tubes supplying high pressure air that forces the expansion cycle. Also shown are two exhaust ports 266, 268 that occur at the end of the expansion cycle. The exhaust ports are designed as indicated, above. The opposing ports are substantially at opposing circumferential ends of the island, enabling two complete applications of expansion and exhaust for each complete revolution of the contour within the chamber.

That is, because there is no intake and compression that occurs within the engine (high compression air is made outside the engine and by other means) those two cycles are used to double up as a second expansion and exhaust cycle. For each 360 degree rotation a contour will complete two expansion cycles & two exhaust cycles.

Figure 21:
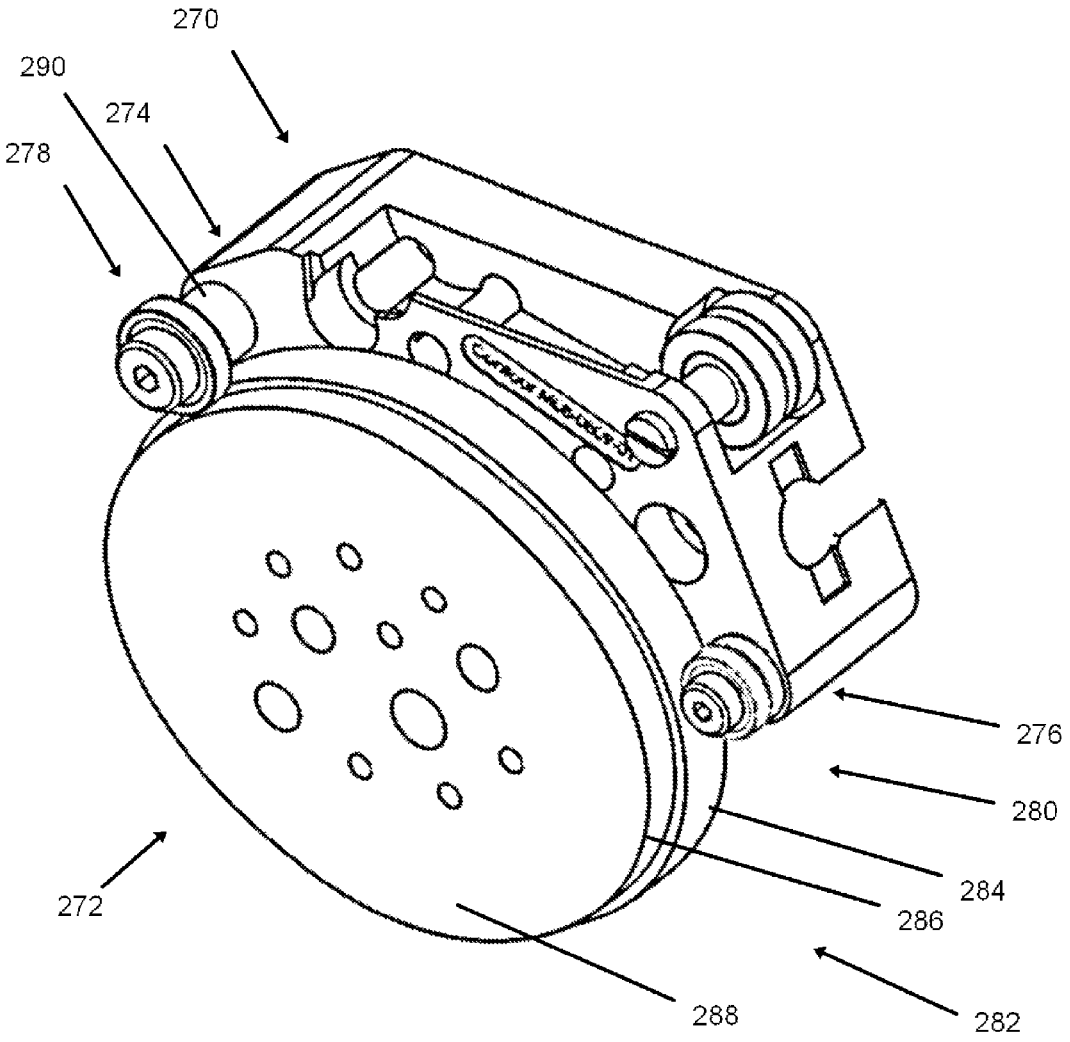
FIG. 21 is a perspective view of an alternative contour and front plate.

FIG. 21 provides an alternative contour 270 and an alternative front-plate 272, the reasons for which will now be discussed. In the first disclosed contour 30, the bearings 178, 180, at circumferentially opposing ends 162, 164 of the contour 30, project outwardly from the front face of the contour 40 by the same distance and they have the same outer diameter. The bearings 178, 180 project over the front-plate outside edge 56, which has a uniform radial outer profile 56.

The opposing circumferential ends 162, 164 of the contour do not move along the same exact path about the island outer surface 58 because of the asymmetrical shape of the island 28. Their slight misalignment with the island outer surface, as the contour turns around the island, requires that the apex seals move inward or outward to adjust for the slight differences.

To minimize the unwanted travel of the apex seals at circumferentially opposing ends of the contour 274, 276, bearings are provided 278, 280 which have mutually unique characteristics. That is, the bearing 278 at the leading circumferential end 274 of the contour 270 projects further from the front face 282 of the contour 270 and has a larger outer diameter than the bearing 280 at the trailing circumferential end 276 of the contour 270.

To receive these bearings 278, 280, the front-plate outside edge 282 has two different outer profiles 284, 286, i.e., an outer profile 284 and an inner profile 286. The outer profile 284 is closer to the front-plate rear face and the inner profile 286 is closer to the front-plate front face 288.

The front-plate outer profile 284 is radially larger than the front-plate inner profile 286, and the outer profile 284 is designed to trace the path of the trailing end bearing 280. On the other hand, the inner profile 286 is designed to trace the path of the leading end bearing 278.

The outer diameters of the leading 278 and trailing 280 end bearings are designed to sit against the respective profiles 286, 284. The stem 290 of the leading bearing 178 is long enough and narrow enough to position the leading end bearing 278 against the inner profile 286 without itself contacting the outer profile 284 of the front-plate 272.

It is to be appreciated that it is not important which bearing 278, 280 has the longer stem. It only matters, in this embodiment, that the front-plate has outer edge profiles which can receive the respective bearings, and that the profiles trace the path traveled by the respective bearings 278, 280. This will minimize or prevent the contour 270 from undergoing the stated unwanted motion during the combustion cycle.

Figure 22:
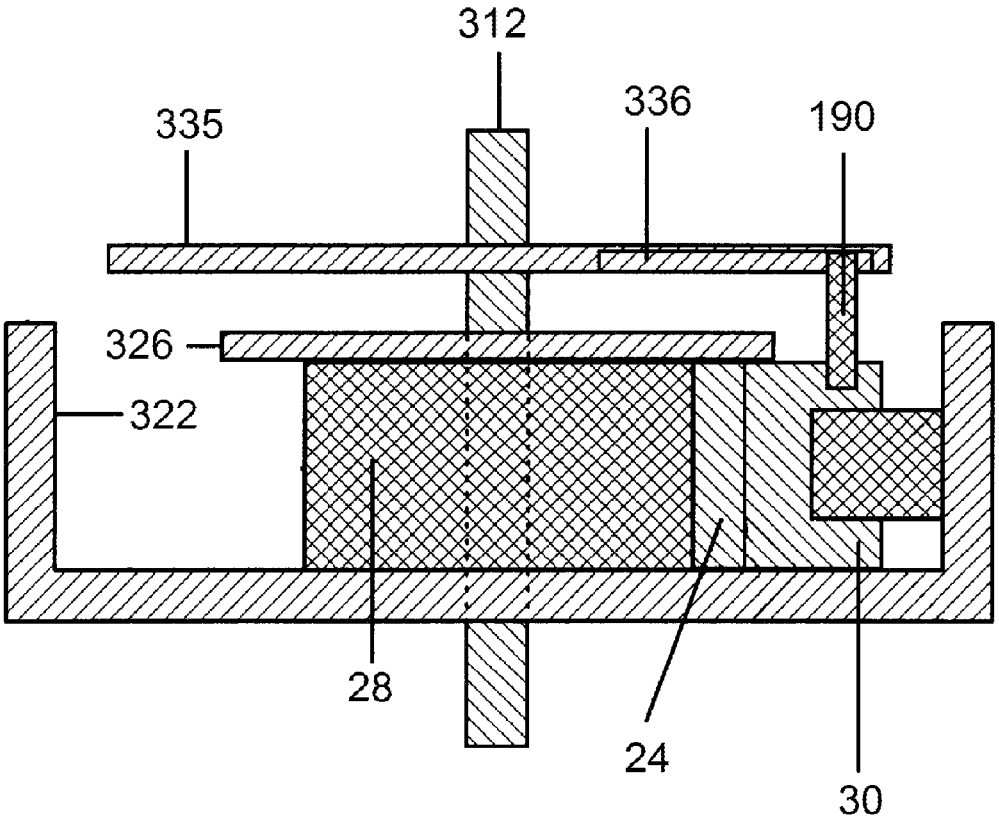
FIG. 22 is a schematic diagram of an embodiment of a rotary engine showing the relative positioning of the island, crankshaft, crank plate, contour, and other components.

FIG. 22 is a cross-sectional view of a rotary machine in accordance with the disclosure, illustrating the relative position of a crank disk 335 having one or more slots 336 mounted on a crank shaft 312. As shown in FIG. 22, crank disk 335 can be situated on the opposite side of front plate 326 from chamber 322. According to various embodiments, crank disk 335 can include one or more slots 336 for interaction with crank pivots 190 disposed on concave-shaped contour 330. According to various embodiments, the slot 336 can be a recess, chamber, channel, or other depression capable of receiving crank pivot 190 in crank disk 335, as shown in FIG. 22. According to various embodiments, the slot 336 can extend through crank disk 335 such that crank pivot 190 can extend through crank disk 335 and beyond a top surface of crank disk 335. The crank disk 335 can be connected to the crank shaft 312 directly or through interaction of one or more gear, belt, or other device capable of turning crank shaft 312. According to various embodiments, crank disk 335 can be permanently attached to crank shaft 312 so that crank shaft 312 rotates with crank disk 335.

In sum, the above disclosed embodiments provide for the placement of one or more roller bearings along the side of the moveable contour such that the roller bearings make constant contact with the outer surface of the front-plate to effect the turning of the contour within the chamber area as the contour rotates around the fixed island.

The combustion chamber is configured as multiple parts layered in sequence to form the whole IDAR, and each layer is aligned with the others through a series of alignment posts or connectors.

In one disclosed embodiment, the intake port is supplied through a series of small holes in the perimeter of the island which are connected to a larger opening routed through the body of the island and out the back of the chamber. In this embodiment, the placement of a barrel valve through the back of the chamber and body of the island that connects and controls the intake flow through the island configured intake holes.

In another disclosed embodiment, the placement of a rotary valve with attached stem piece that passes through the back of the chamber and body of the island that connects and controls the intake flow through the island configured intake orifices.

In another disclosed embodiment, a configuration of the engine where one or more sparkplugs are mounted within the moveable contours with the connecting point to the sparkplug attached to an antenna that picks up the timed spark energy as it moves through a proximity area relative to a stationary high voltage conductor.

In the disclosed embodiments, apex seals are used which contact the surface of the front-plate and the back-plate.

In one disclosed embodiment, a petal valve is mounted on the backside of the engine chamber over the exhaust port to effect the opening and closing of the exhaust port.

In another disclosed embodiment, a rotary valve is mounted on the backside of the engine chamber over the exhaust port to effect the opening and closing of the exhaust port.

In another disclosed embodiment, a fractional portion of the concave contour surface that faces the island surface is removed to effect a process of internal gas re-circulation directly between the exhaust and intake cycles.

Accordingly, improvements to inverse displacement asymmetric rotary (IDAR) internal combustion engine technology have been shown. Engine chamber design improvements that simplify the assembly processes and improve tolerances within the engine have been described. Improvements to contour design that eliminate stress on the side seals and apex seals and improve engine compression, functional repeatability and engine life have been described. Improvements to port design, both intake and exhaust and compatible valve design to increase the performance of each cycle have been discussed.

In another disclosed configuration of the IDAR technology, an extension of use is disclosed involving the use of other technologies such that the IDAR functions as a power plant while existing technologies provide high pressure sources of air or fuel and air combinations to the IDAR power plant. In such an instance, the IDAR technology operates as an external combustion power plant, such as being powered by compress air, instead of an internal combustion engine.

Although several embodiments of the present disclosure have been disclosed above, the present disclosure should not to be taken to be limited thereto. In fact, it is to be understood that one of ordinary skill in the art will be able to devise numerous arrangements, which, although not specifically shown or described, will embody the principles of the present disclosure and will fall within its scope. Modifications to the above would be obvious to those of ordinary skill in the art, but would not bring the disclosure so modified beyond the scope of the appended claims.

The invention claimed is:

1. A rotary machine, comprising:

a) an island having an elliptical front face and an elliptical rear face separated by an island outer surface defined between the front face and the rear face;

b) a front plate disposed against the front face of the island, the front plate having a cam-shaped perimeter;

c) a back plate disposed against the rear face of the island;

d) at least one contour having a radially inwardly facing concave face that is biased toward the island outer surface, wherein a working volume is defined between the concave face of the contour, the front plate, the back plate, and the island outer surface;

e) a cylindrical rotatable barrel valve rotatably disposed in an opening on the front plate including a plurality of slots on circumferentially opposing sides, wherein working fluid can be selectively delivered to the working volume via the barrel valve;

f) a crankshaft adapted to cause relative rotational motion between the contour and the island;

g) at least one intake port for introducing a working fluid into the working volume; and h) at least one exhaust port for removing the working fluid from the working volume.

2. The rotary machine of claim 1, wherein the barrel valve is a slotted barrel valve.

3. The rotary machine of claim 1, wherein the contour further includes: side-face seals, engaging the front plate and the back plate; and circumferentially opposing apex seals, engaging the island outer surface when the contour is biased toward the island.

4. The rotary machine of claim 1, wherein the rotary machine is an internal combustion engine.

5. The rotary machine of claim 1, wherein the rotary machine is configured to be driven by a pressurized fluid.

6. The rotary machine of claim 5, wherein the rotary machine is configured to be driven by compressed air.

7. The rotary machine of claim 1, wherein the contour includes a spark plug receiving port and a spark plug disposed in the spark plug receiving port that extends through the inwardly facing concave face of the contour, wherein at least one sparkplug electrode enters the working volume to facilitate combustion.

8. The rotary machine of claim 1, wherein the contour is attached to and rotates with the crankshaft around the island.

* * * * *